US009791180B2

(12) United States Patent
Shimamoto et al.

(10) Patent No.: US 9,791,180 B2
(45) Date of Patent: Oct. 17, 2017

(54) AIR-CONDITIONING APPARATUS

(75) Inventors: Daisuke Shimamoto, Tokyo (JP); Osamu Morimoto, Tokyo (JP); Takayoshi Honda, Tokyo (JP); Koji Azuma, Tokyo (JP); Koji Nishioka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 677 days.

(21) Appl. No.: 14/347,820

(22) PCT Filed: Nov. 30, 2011

(86) PCT No.: PCT/JP2011/006686

§ 371 (c)(1),
(2), (4) Date: Mar. 27, 2014

(87) PCT Pub. No.: WO2013/080255

PCT Pub. Date: Jun. 6, 2013

(65) Prior Publication Data

US 2014/0238061 A1 Aug. 28, 2014

(51) Int. Cl.
*F25B 13/00* (2006.01)
*F25D 17/00* (2006.01)
(Continued)

(52) U.S. Cl.
CPC ..... *F25B 13/00* (2013.01); *F24F 3/065* (2013.01); *F25B 49/02* (2013.01);
(Continued)

(58) Field of Classification Search
CPC .... F24F 2011/0045; F24F 3/065; F24F 11/02; F25B 2313/0314; F25B 2500/19;
(Continued)

(56) References Cited

U.S. PATENT DOCUMENTS 4,420,947 A * 12/1983 Yoshino ..... F24D 11/0264 126/585
4,498,310 A * 2/1985 Imanishi ..... F25B 13/00 236/92 B
(Continued)

FOREIGN PATENT DOCUMENTS

JP 02-306046 A 12/1990
JP 2000-227242 A 8/2000
(Continued)

OTHER PUBLICATIONS

Office Action dated Feb. 3, 2016 issued in corresponding CN patent application No. 201180075162.6 (and English translation).
(Continued)

*Primary Examiner* — Henry Crenshaw
(74) *Attorney, Agent, or Firm* — Posz Law Group, PLC

(57) ABSTRACT

An air-conditioning apparatus includes a temperature sensor for detecting a temperature of the heat medium sent from each of the intermediate heat exchangers to each of the use-side heat exchangers, and a temperature of the heat medium that has exited each of the use-side heat exchangers, an opening degree controller for regulating a flow rate of the heat medium through each of the heat medium flow control devices, and a computing unit for computing a usage capacity of each of the indoor units from a rotation speed of the pump, an opening degree of each of the heat medium flow control devices, temperatures detected by the temperature sensors, and power consumption of each of the indoor units, and proportionally dividing the power consumption for a common portion among each of the indoor units based on the computed usage capacity and the power consumption of the common portion.

10 Claims, 11 Drawing Sheets

(51) Int. Cl.

| | |
|---|---|
| ***F25B 41/00*** | (2006.01) |
| ***F24F 3/06*** | (2006.01) |
| ***F25B 49/02*** | (2006.01) |
| *F24F 11/00* | (2006.01) |
| *F25B 25/00* | (2006.01) |

(52) U.S. Cl.
CPC ..... *F24F 2011/0045* (2013.01); *F25B 25/005* (2013.01); *F25B 2313/003* (2013.01); *F25B 2313/0231* (2013.01); *F25B 2313/02732* (2013.01); *F25B 2313/02741* (2013.01); *F25B 2313/0312* (2013.01); *F25B 2313/0314* (2013.01); *F25B 2313/0315* (2013.01); *F25B 2500/19* (2013.01); *F25B 2500/26* (2013.01); *F25B 2600/2513* (2013.01); *F25B 2700/1931* (2013.01); *F25B 2700/1933* (2013.01); *F25B 2700/21151* (2013.01); *F25B 2700/21152* (2013.01); *F25B 2700/21161* (2013.01); *F25B 2700/21162* (2013.01); *F25B 2700/21163* (2013.01); *F25B 2700/21173* (2013.01); *F25B 2700/21174* (2013.01); *F25B 2700/21175* (2013.01)

(58) Field of Classification Search
CPC ..... F25B 25/005; F25B 2600/2513; F25B 2700/21174; F25B 2700/21175
USPC ..... 62/160, 186, 211
See application file for complete search history.

(56) References Cited

U.S. PATENT DOCUMENTS

| | | | | |
|---|---|---|---|---|
| 6,637,229 | B1 * | 10/2003 | Forrest | B60H 1/3208 62/183 |
| 8,844,302 | B2 * | 9/2014 | Takata | F25B 13/00 62/127 |
| 2002/0144510 | A1 * | 10/2002 | Park | F25D 11/022 62/186 |
| 2003/0093236 | A1 * | 5/2003 | Wu | G06N 3/126 702/85 |
| 2006/0213209 | A1 * | 9/2006 | Tanaami | F24D 19/1054 62/238.6 |
| 2010/0252029 | A1 * | 10/2010 | Kanai | F24D 11/003 126/643 |
| 2014/0238061 | A1 * | 8/2014 | Shimamoto | F25B 13/00 62/160 |

FOREIGN PATENT DOCUMENTS

| | | | |
|---|---|---|---|
| WO | 2010/109617 | A1 | 9/2010 |
| WO | 2011030418 | A1 | 3/2011 |
| WO | 2011/080804 | A1 | 7/2011 |

OTHER PUBLICATIONS

International Search Report of the International Searching Authority mailed Feb. 28, 2012 for the corresponding international application No. PCT/JP2011/006686 (with English translation).

European Extended Search Report issued on Jun. 24, 2015 in the corresponding EP application No. 11876581.7.

Office Action dated Sep. 5, 2016 issued in corresponding CN patent application No. 201180075162.6 (and English translation).

Office Action dated Jan. 4, 2017 issued in corresponding European patent application No. 11 876 581.7.

* cited by examiner

FIG. 11

FcvX CHART
<INDOOR UNIT CAPACITY 10 kW>

| | T39 INDOOR SUCTION TEMPERATURE (DRY-BULB TEMPERATURE [CALCULATED AT CONSTANT HUMIDITY]) (°C) | | | | | | | | | |
|---|---|---|---|---|---|---|---|---|---|---|
| T31 (°C) | 15 | 16 | 17 | 18 | 19 | 20 | 21 | 22 | 23 | 24 |
| 0 | | | | | | | | | | |
| 1 | | | | | | | | | | |
| 2 | | | | | | | | | | |
| 3 | | | | | | | | | | |
| 4 | | | | | | | | | | |
| 5 | | | | | | | | | | |
| 6 | | | | | | | | | | |
| 7 | | | | | | | | | | |
| 8 | | | | | | | | | | |
| 9 | | | | | | | | | | |
| 10 | | | | | | | | | | |
| 11 | | | | | | | | | | |
| 12 | | | | | | | | | | |
| 13 | | | | | | | | | | |
| 14 | | | | | | | | | | |
| 15 | | | | | | | | | | |
| 16 | | | | | | | | | | |
| 17 | | | | | | | | | | |
| 18 | | | | | | | | | | |
| 19 | | | | | | | | | | |
| 20 | | | | | | | | | | |
| 21 | | | | | | | | | | |
| 22 | | | | | | | | | | |
| 23 | | | | | | | | | | |
| 24 | | | | | | | | | | |

AIR-CONDITIONING APPARATUS

CROSS REFERENCE TO RELATED APPLICATION

This application is a U.S. national stage application of International Patent Application No. PCT/JP2011/006686 filed on Nov. 30, 2011.

TECHNICAL FIELD

The present invention relates to an air-conditioning apparatus applied to a multi-air-conditioning apparatus for a building or the like, for example.

BACKGROUND

In some air-conditioning apparatuses, like a multi-air-conditioning apparatus for a building, a heat source unit (outdoor unit) is installed outside a structure, and an indoor unit is installed in the indoor of the structure. A refrigerant that circulates through a refrigerant circuit of such an air-conditioning apparatus rejects heat to (removes heat from) air supplied to a heat exchanger of the indoor unit to thereby heat or cool the air. Then, the heated or cooled air is sent to an air-conditioned space to perform heating or cooling.

A building usually has a plurality of indoor spaces, and accordingly, such an air-conditioning apparatus also includes a plurality of indoor units. In the case of a large-scale building, the refrigerant pipe that connects the outdoor unit and each of the indoor units sometimes becomes as long as 100 m. When the length of the pipe connecting the outdoor unit and each of the indoor units is large, the amount of refrigerant charged into the refrigerant circuit increases accordingly.

Such indoor units of a multi-air-conditioning apparatus for a building are usually installed and used in an indoor space where humans exist (for example, an office space, a living room, or a shop). If, for some reason, a refrigerant leaks from an indoor unit installed in the indoor space, this may present a problem from the viewpoint of its effect on human body and safety, because some kinds of refrigerant have flammability and toxicity. Even if the refrigerant used is not hazardous to humans, it is conceivable that the refrigerant leak may cause oxygen concentration to decrease in the indoor space, which may exert an effect on human body.

The following method has been conceived to address this problem. That is, a secondary loop system is adopted for the air-conditioning apparatus, in which a refrigerant is used for the primary-side loop, and water or brine, which is not hazardous, is used for the secondary-side loop to provide air conditioning for the space where humans exist (see, for example, Patent Literature 1).

Aside from this problem, in the case of a multi-air-conditioning apparatus for a building, it is necessary to calculate the electric bill for each tenant using an indoor unit. Accordingly, indoor unit capacity is proportionally calculated in accordance with the usage capacity of each indoor unit as determined from, for example, the opening degree of an electronic expansion valve provided in association with each indoor unit. However, for the novel secondary loop air-conditioning system as described in Patent Literature 1, there is no method for calculating the load on each indoor unit, and it has been impossible to use a method conventionally adopted for a multi-air-conditioning apparatus for a building which uses a refrigerant.

CITATION LIST

Patent Literature

Patent Literature 1: Japanese Unexamined Patent Application Publication No. 2000-227242 (Abstract and FIG. 1)

Technical Problem

For air-conditioning apparatuses adopting a secondary loop system as described in Patent Literature 1, there are no proposed means and method for calculating the electric bill for each tenant using an indoor unit as in the case of conventional multi-air-conditioning apparatuses, and hence it has been impossible to calculate the electric bill individually.

SUMMARY

An air-conditioning apparatus according to the present invention allows the power consumption for the portion common to each indoor unit (hereinafter, common portion) to be proportionally divided among individual indoor units even in the case of a secondary loop multi-air-conditioning apparatus for a building which uses a refrigerant for the heat medium on the heat source unit side and water or the like for the use-side heat medium, thereby making it possible to calculate the electric usage bill for each indoor unit.

An air-conditioning apparatus according to the present invention includes a refrigerant circuit configured to circulate a heat source-side refrigerant, the refrigerant circuit being a refrigerant-side flow path formed by connecting, with refrigerant pipes, a compressor, a refrigerant flow switching device, a heat source-side heat exchanger, a plurality of expansion devices, and a plurality of intermediate heat exchangers that exchange heat between the heat source-side refrigerant and a heat medium different from the refrigerant, a heat medium circuit configured to circulate the heat medium, the heat medium circuit being a heat medium-side flow path formed by connecting, with heat medium pipes, a pump, a plurality of heat medium flow switching devices, a plurality of use-side heat exchangers that act as indoor units, a plurality of heat medium flow control devices, and the intermediate heat exchangers, temperature detecting means for detecting a temperature of the heat medium sent from each of the intermediate heat exchangers to each of the use-side heat exchangers, and a temperature of the heat medium that has exited each of the use-side heat exchangers, opening degree control means for regulating a flow rate of the heat medium through each of the heat medium flow control devices, and computing means for computing a usage capacity of each of the indoor units from a rotation speed of the pump, an opening degree of each of the heat medium flow control devices, a temperature detected by the temperature detecting means, and a power consumption of each of the indoor units itself, and on a basis of the computed usage capacity and a power consumption for a common portion that is common to each of the indoor units, proportionally dividing the power consumption for the common portion among each of the indoor units.

For air-conditioning apparatuses that employ a secondary loop system, the power consumption for the common portion can be proportionally divided among each indoor unit, thereby making it possible to calculate the electric usage bill for each indoor unit.

BRIEF DESCRIPTION OF DRAWINGS

FIG. 11 illustrates an example of a reference chart used for Fcv correction.

DETAILED DESCRIPTION

Embodiment 1

First, an overview of an air-conditioning apparatus 100 according to Embodiment of the present invention will be described with reference to FIGS. 1 and 2. The air-conditioning apparatus 100 according to Embodiment 1 has a refrigerant circuit A (see FIG. 2) and a heat medium circuit B (see FIG. 2). For the refrigerant circuit A, as a heat source-side refrigerant, for example, a single refrigerant such as R-22 or R-134a, a near-azeotropic refrigerant mixture such as R-410A or R404-A, a zeotropic refrigerant mixture such as R-407C, a refrigerant such as $CF_3CH{=}CH_2$ including a double bond in the chemical formula and considered to have a relatively small global warming potential or a mixture thereof, or a natural refrigerant such as $CO_2$ or propane is adopted. For the heat medium circuit B, water or the like is adopted as a use-side heat medium. The refrigerant circuit A constitutes a refrigeration cycle, and each of indoor units 2 (2*a* to 2*d*) (hereinafter, also sometimes referred to singularly as "indoor unit 2" when there is no need to distinguish between the individual indoor units; the same also applies to other components described herein) constituting the heat medium circuit B is allowed to freely select a cooling mode or a heating mode as an operation mode.

The air-conditioning apparatus 100 according to Embodiment 1 adopts a system that indirectly uses a heat source-side refrigerant (indirect system). That is, the air-conditioning apparatus 100 transfers cooling energy or heating energy stored in the heat source-side refrigerant to a heat medium different from the heat source-side refrigerant (hereinafter, simply referred to as heat medium), and cools or heats an air-conditioned space by the cooling energy or heating energy stored in the heat medium.

Figure 1:
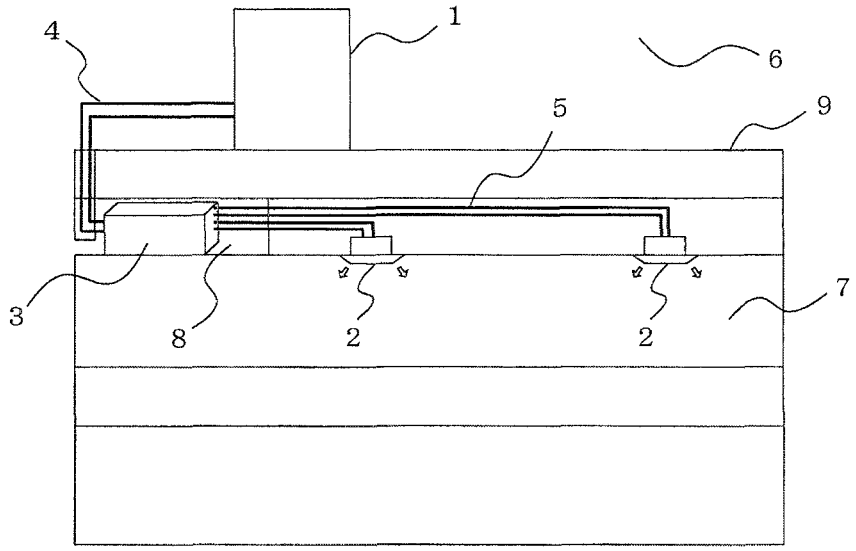
FIG. 1 is a schematic diagram illustrating an installation example of an air-conditioning apparatus according to Embodiment of the present invention.

As illustrated in FIG. 1, the air-conditioning apparatus 100 according to Embodiment 1 has a single outdoor unit 1 that is a heat source unit, a plurality of indoor units 2, and a heat medium relay unit (relay unit) 3 located between the outdoor unit 1 and the indoor unit 2. The heat medium relay unit 3 exchanges heat between the heat source-side refrigerant and the heat medium. The outdoor unit 1 and the heat medium relay unit 3 are connected by a refrigerant pipe 4 used for circulating the heat source-side refrigerant. The heat medium relay unit 3 and the indoor unit 2 are connected by a pipe (heat medium pipe) 5 used for circulating the heat medium.

The outdoor unit 1 is usually installed in an outdoor space 6, which is a space outside a structure 9 such as a building (for example, the rooftop or the like). The outdoor unit 1 supplies cooling energy or heating energy to the indoor unit 2 via the heat medium relay unit 3.

The indoor unit 2 is installed at a position that allows cooling air or heating air to be supplied to an indoor space 7, which is a space inside the structure 9 (for example, a living room or the like). The indoor unit 2 supplies cooling air or heating air to the indoor space 7 that is the air-conditioned space.

The heat medium relay unit 3 is installed at a position (a space 8 in this example) different from the outdoor space 6 and the indoor space 7, as a separate casing from the outdoor unit 1 and the indoor unit 2. The heat medium relay unit 3 is connected to the outdoor unit 1 and the indoor units 2 by the refrigerant pipe 4 and the pipe 5, respectively. Cooling energy or heating energy supplied from the outdoor unit 1 is transferred to the indoor unit 2 via the heat medium relay unit 3.

As illustrated in FIG. 1, in the air-conditioning apparatus 100 according to Embodiment 1, the outdoor unit 1 and the heat medium relay unit 3 are connected via two lines of the refrigerant pipe 4, and the heat medium relay unit 3 and each of the indoor units 2*a* to 2*d* are connected via two lines of the pipe 5. In this way, in the air-conditioning apparatus 100 according to Embodiment 1, individual units (the outdoor unit 1, the indoor unit 2, and the heat medium relay unit 3) are connected by using the refrigerant pipe 4 and the pipe 5, thereby allowing easy construction.

It should be noted that FIG. 1 illustrates, by way of example, a state in which the heat medium relay unit 3 is installed in the space 8, which is a space located inside the structure 9 but is a separate space from the indoor space 7, such as a space above a ceiling. Alternatively, the heat medium relay unit 3 may be installed in a common use space or the like where an elevator or the like is located. While FIG. 1 illustrates a case where the indoor unit 2 is of a ceiling cassette type by way of example, this should not be construed restrictively. That is, the air-conditioning apparatus 100 may be of any type as long as heating air or cooling air can be supplied to the indoor space 7 directly or through a duct or the like, such as a ceiling concealed type or ceiling suspended type.

While FIG. 1 illustrates a case where the outdoor unit 1 is installed in the outdoor space 6 by way of example, this should not be construed restrictively. For example, the outdoor unit 1 may be installed in an enclosed space such as a machine room with ventilation openings, or may be installed inside the structure 9 as long as waste heat can be exhausted to the outside of the structure 9 by an exhaust duct. Alternatively, the outdoor unit 1 may be installed inside the structure 9 also in a case where a water-cooled outdoor unit 1 is used. Installing the outdoor unit 1 in these locations does not present any particular problems.

The heat medium relay unit 3 may be installed at a position near the outdoor unit 1. However, it is to be noted that if the distance from the heat medium relay unit 3 to the indoor unit 2 is too long, the power necessary for conveying the heat medium becomes very large, with the result that the energy saving effect diminishes. Further, the numbers of the outdoor units 1, indoor units 2, and heat medium relay units 3 to be connected are not particularly limited to those illustrated in FIG. 1. For example, the numbers of these units may be determined in accordance with the structure 9 in which the air-conditioning apparatus 100 is installed.

Next, with reference to FIG. 2, the circuit configurations for the refrigerant and the heat medium in the air-conditioning apparatus 100 according to Embodiment 1 will be described. As illustrated in FIG. 2, the outdoor unit 1 and the heat medium relay unit 3 are connected by the refrigerant pipe 4 via intermediate heat exchangers 15 (15*a* and 15*b*) provided in the heat medium relay unit 3. Further, the heat medium relay unit 3 and the indoor units 2 are also connected by the pipe 5 via the intermediate heat exchangers 15 (15*a* and 15*b*).

[Outdoor Unit 1]

The outdoor unit 1 is equipped with a compressor 10 that compresses the refrigerant, a first refrigerant flow switching device 11 configured by a four-way valve or the like, a heat source-side heat exchanger 12 that functions as an evaporator or a condenser, and an accumulator 19 that accumulates the excess refrigerant, which are connected by the refrigerant pipe 4.

The outdoor unit 1 is also provided with a first connection pipe 4*a*, a second connection pipe 4*b*, and check valves 13 (13*a* to 13*d*). The provision of the first connection pipe 4*a*, the second connection pipe 4*b*, the check valve 13*a*, the check valve 13*b*, the check valve 13*c*, and the check valve 13*d* allows the heat source-side refrigerant, which enters the heat medium relay unit 3 from the outdoor unit 1, to flow in a constant direction irrespective of the operation required for the indoor unit 2.

The compressor 10 sucks the heat source-side refrigerant, and compresses the heat source-side refrigerant into a high-temperature/high-pressure state. The compressor 10 is preferably configured by, for example, an inverter compressor or the like whose capacity can be controlled.

The first refrigerant flow switching device 11 switches between the flow of the heat source-side refrigerant in a heating operation mode (in a heating only operation mode and in a heating main operation mode), and the flow of the heat source-side refrigerant in a cooling operation mode (in a cooling only operation mode and in a cooling main operation mode).

The heat source-side heat exchanger 12 functions as an evaporator in the heating operation, and functions as a condenser in the cooling operation. The heat source-side heat exchanger 12 exchanges heat between air supplied from an unillustrated air-sending device such as a fan, and the heat source-side refrigerant.

A second pressure sensor 37 and a third pressure sensor 38 that are pressure detecting devices are located on the upstream and downstream sides of the compressor 10, respectively. The flow rate of refrigerant discharged from the compressor 10 can be calculated from the rotation speed of the compressor 10, and values detected by the pressure sensors 37 and 38.

[Indoor Units 2]

The indoor units 2 (2*a* to 2*d*) are equipped with use-side heat exchangers 26 (26*a* to 26*d*), respectively. The use-side heat exchangers 26 are connected to heat medium flow control devices 25 (25*a* to 25*d*) and second heat medium flow switching devices 23 (23*a* to 23*d*) of the heat medium relay unit 3, respectively, via the pipe 5. The use-side heat exchangers 26 exchange heat between air supplied from an unillustrated air-sending device such as a fan, and the heat medium, and generate the heating air or cooling air that is to be supplied to the indoor space 7. The indoor units 2 (2*a* to 2*d*) are also provided with suction air temperature sensors 39 (39*a* to 39*d*), respectively.

[Heat Medium Relay Unit 3]

The heat medium relay unit 3 is provided with two intermediate heat exchangers 15 (15*a* and 15*b*) in which the refrigerant and the heat medium exchange heat, two expansion devices 16 (16*a* and 16*b*) that decompress the refrigerant, two opening and closing devices 17 (17*a* and 17*b*) that open and close the flow path of the refrigerant pipe 4, two second refrigerant flow switching devices 18 (18*a* and 18*b*) that switch refrigerant flow paths, two pumps 21 (21*a* and 21*b*) that cause the heat medium to circulate, four first heat medium flow switching devices 22 (22*a* to 22*d*) that are connected to one side of the pipe 5, four second heat medium flow switching devices 23 (23*a* to 23*d*) that are connected to the other side of the pipe 5, and four heat medium flow control devices 25 (25*a* to 25*d*) that are connected to the side of the pipe 5 to which the first heat medium flow switching devices 22 (22*a* to 22*d*) are connected.

The intermediate heat exchangers 15*a* and 15*b* each function as a condenser (radiator) or an evaporator, exchange heat between the heat source-side refrigerant and the heat medium, and transfer the cooling energy or heating energy generated in the outdoor unit 1 and stored in the heat source-side refrigerant to the heat medium. The intermediate heat exchanger 15*a* is provided between the expansion device 16*a* and the second refrigerant flow switching device 18*a* in the refrigerant circuit A, and cools the heat medium in the cooling and heating mixed operation mode. The intermediate heat exchanger 15*b* is provided between the expansion device 16*b* and the second refrigerant flow switching device 18*b* in the refrigerant circuit A, and heats the heat medium in the cooling and heating mixed operation mode.

The expansion devices 16*a* and 16*b* each function as a pressure reducing valve or an expansion valve, and decompress and expand the heat source-side refrigerant. The expansion device 16*a* is provided upstream of the intermediate heat exchanger 15*a* in the flow of the heat source-side refrigerant in the cooling only operation mode. The expansion device 16*b* is provided upstream of the intermediate heat exchanger 15*b* in the flow of the heat source-side refrigerant in the cooling only operation mode. The expansion devices 16 may each be configured by a device whose opening degree can be variably controlled, for example, an electronic expansion valve or the like.

The opening and closing devices 17*a* and 17*b* are each configured by a two-way valve or the like, and open and close the flow path of the refrigerant pipe 4.

The second refrigerant flow switching devices 18*a* and 18*b* are each configured by a four-way valve or the like, and switch the flows of the heat source-side refrigerant in accordance with the operation mode. The second refrigerant flow switching device 18*a* is provided downstream of the intermediate heat exchanger 15*a* in the flow of the heat source-side refrigerant in the cooling only operation mode. The second refrigerant flow switching device 18*b* is provided downstream of the intermediate heat exchanger 15*b* in the flow of the heat source-side refrigerant in the cooling only operation mode.

The pumps 21*a* and 21*b* circulate the heat medium inside the pipe 5. The pump 21*a* is provided in the portion of the pipe 5 between the intermediate heat exchanger 15*a* and the second heat medium flow switching device 23. The pump 21*b* is provided in the portion of the pipe 5 between the intermediate heat exchanger 15*b* and the second heat medium flow switching device 23. The pumps 21 may each be configured by, for example, a pump or the like whose capacity can be controlled. Alternatively, the pump 21*a* may be provided in the portion of the pipe 5 between the intermediate heat exchanger 15*a* and the first heat medium flow switching device 22. Further, the pump 21*b* may be provided in the portion of the pipe 5 between the intermediate heat exchanger 15*b* and the first heat medium flow switching device 22.

The first heat medium flow switching devices 22*a* to 22*d* are each configured by a three-way valve or the like, and switch the flow paths of the heat medium. The number of first heat medium flow switching devices 22*a* to 22*d* to be provided correspond to the number of indoor units 2 to be installed. The three sides of the first heat medium flow switching device 22 are connected to the intermediate heat exchanger 15*a*, the intermediate heat exchanger 15*b*, and the heat medium flow control device 25, respectively. In association with the respective indoor units 2, the first heat medium flow switching device 22*a*, the first heat medium flow switching device 22*b*, the first heat medium flow switching device 22*c*, and the first heat medium flow switching device 22*d* are illustrated in this order from the lower side in the plane of the drawing.

The second heat medium flow switching devices 23*a* to 23*d* are each configured by a three-way valve or the like, and switch the flow paths of the heat medium. The number of second heat medium flow switching devices 23*a* to 23*d* to be provided corresponds to the number of indoor units 2 to be installed. The three sides of the second heat medium flow switching device 23 are connected to the intermediate heat exchanger 15*a*, the intermediate heat exchanger 15*b*, and the use-side heat exchanger 26, respectively. The second heat medium flow switching device 23 is provided on the inlet side of the heat medium flow path of the use-side heat exchanger 26. In association with the respective indoor units 2, the second heat medium flow switching device 23*a*, the second heat medium flow switching device 23*b*, the second heat medium flow switching device 23*c*, and the second heat medium flow switching device 23*d* are illustrated in this order from the lower side in the plane of the drawing.

The heat medium flow control devices 25*a* to 25*d* are each configured by a two-way valve or the like whose opening area can be controlled, and control the flow rate of the heat medium flowing to the pipe 5. The number of heat medium flow control devices 25 to be provided corresponds to the number of indoor units 2 to be installed. One side and the other side of the heat medium flow control device 25 are connected to the use-side heat exchanger 26 and the first heat medium flow switching device 22, respectively. The heat medium flow control device 25 is provided on the outlet side of the heat medium flow path of the use-side heat exchanger 26. In association with the respective indoor units 2, the heat medium flow control device 25*a*, the heat medium flow control device 25*b*, the heat medium flow control device 25*c*, and the heat medium flow control device 25*d* are illustrated in this order from the lower side in the plane of the drawing. Alternatively, the heat medium flow control device 25 may be provided on the inlet side of the heat medium flow path of the use-side heat exchanger 26.

The heat medium relay unit 3 includes first temperature sensors 31 (31*a* and 31*b*) that each measure the temperature of the heat medium that has exited the intermediate heat exchanger 15, second temperature sensors 34 (34*a* to 34*d*) that each measure the temperature of the heat medium that has exited the indoor unit 2, and third temperature sensors 35 (35*a* to 35*d*) that each measure the temperature of refrigerant at the outlet and inlet of the intermediate heat exchanger 15. Further, the heat medium relay unit 3 is also provided with a fourth temperature sensor 50 and a first pressure sensor 36. Pieces of information detected by these sensors (for example, temperature information and pressure information) are sent to controllers 52 and 57 that control the operation of the air-conditioning apparatus 100 in a centralized manner, and are used to control the driving frequency of the compressor 10, the rotation speed of an unillustrated air-sending device provided near the heat source-side heat exchanger 12 and the use-side heat exchanger 26, switching of the first refrigerant flow switching device 11, the driving frequency of the pump 21, switching of the second refrigerant flow switching device 18, switching of the flow paths of the heat medium, and the like.

The controllers 52 and 57 are each configured by a microcomputer or the like, and calculate evaporating temperature, condensing temperature, saturation temperature, the degree of superheat, and the degree of subcooling on the basis of the result computed by computing unit of the controller 52. Then, on the basis of the calculation results of these values, each of the controllers controls the opening degree of the expansion device 16, the rotation speed of the compressor 10, the fan speeds (including ON/OFF) of the heat source-side heat exchanger 12 and use-side heat exchanger 26, and the like, thereby regulating the operation of the air-conditioning apparatus 100. Other than these, each of the controllers also controls the driving frequency of the compressor 10, the rotation speed (including ON/OFF) of the air-sending device, switching of the first refrigerant flow switching device 11, driving of the pump 21, the opening degree of the expansion device 16, opening and closing of the opening and closing device 17, switching of the second refrigerant flow switching device 18, switching of the first heat medium flow switching device 22, switching of the second heat medium flow switching device 23, the opening degree of the heat medium flow control device 25, and the like, on the basis of information detected by various sensors and instructions from a remote control. That is, the controllers 52 and 57 control various pieces of equipment in a centralized manner in order to execute various operation modes described later.

Further, in Embodiment 1, one of the controllers 52 and 57 computes the proportional power consumption for each indoor unit 2 described later. While the controller 52 is provided in the heat medium relay unit 3 and the controller 57 is provided in the outdoor unit 1 in this example, those controllers may be integrated together.

The first temperature sensors 31*a* and 31*b* each detect the temperature of the heat medium that has exited the intermediate heat exchanger 15, that is, the temperature of the heat medium at the outlet of the intermediate heat exchanger 15. The first temperature sensor 31*a* is provided in the pipe 5 on the inlet side of the pump 21*a*. The first temperature sensor 31*b* is provided in the pipe 5 on the inlet side of the pump 21*b*.

The second temperature sensors 34*a* to 34*d* are each provided between the first heat medium flow switching device 22 and the heat medium flow control device 25, and detect the temperature of the heat medium that has exited the use-side heat exchanger 26. The number of second temperature sensors 34 to be provided corresponds to the number of indoor units 2 to be installed. In association with the respective indoor units 2, the second temperature sensor 34*a*, the second temperature sensor 34*b*, the second temperature sensor 34*c*, and the second temperature sensor 34*d* are illustrated in this order from the lower side in the plane of the drawing.

The four third temperature sensors 35*a* to 35*d* are each provided on the inlet side or outlet side of the heat source-side refrigerant of the intermediate heat exchanger 15, and detect the temperature of the heat source-side refrigerant entering or exiting the intermediate heat exchanger 15. The third temperature sensor 35*a* is provided between the intermediate heat exchanger 15*a* and the second refrigerant flow switching device 18*a*. The third temperature sensor 35*b* is provided between the intermediate heat exchanger 15*a* and the expansion device 16*a*. The third temperature sensor 35*c* is provided between the intermediate heat exchanger 15*b* and the second refrigerant flow switching device 18*b*. The third temperature sensor 35*d* is provided between the intermediate heat exchanger 15*b* and the expansion device 16*b*.

The fourth temperature sensor 50 obtains temperature information used when computing the evaporating temperature and the dew point temperature. The fourth temperature sensor 50 is provided between the expansion device 16*a* and the expansion device 16*b*.

The pipe 5 for circulating the heat medium includes a pipe connected to the intermediate heat exchanger 15*a*, and a portion connected to the intermediate heat exchanger 15*b*. The pipe 5 is divided into branches in accordance with the number of indoor units 2 connected to the heat medium relay unit 3, and is connected to the first heat medium flow switching device 22 and the second heat medium flow switching device 23. Whether to make the heat medium from the intermediate heat exchanger 15*a* enter the use-side heat exchanger 26 or make the heat medium from the intermediate heat exchanger 15*b* enter the use-side heat exchanger 26 is determined by controlling the first heat medium flow switching device 22 and the second heat medium flow switching device 23.

In the air-conditioning apparatus 100, the refrigerant circuit A is formed by connecting the compressor 10, the first refrigerant flow switching device 11, the heat source-side heat exchanger 12, the opening and closing device 17, the second refrigerant flow switching device 18, the refrigerant flow path of the intermediate heat exchanger 15, the expansion device 16, and the accumulator 19 by the refrigerant pipe 4. The heat medium circuit B is formed by connecting the heat medium flow path of the intermediate heat exchanger 15, the pump 21, the first heat medium flow switching device 22, the heat medium flow control device 25, the use-side heat exchanger 26, and the second heat medium flow switching device 23 by the pipe 5. Further, a plurality of use-side heat exchangers 26 are connected in parallel to each of the intermediate heat exchangers 15, so that the heat medium circuit B is made up of a plurality of lines.

Therefore, in the air-conditioning apparatus 100, the outdoor unit 1 and the heat medium relay unit 3 are connected via the intermediate heat exchanger 15*a* and the intermediate heat exchanger 15*b* that are provided in the heat medium relay unit 3, and the heat medium relay unit 3 and the indoor unit 2 are also connected via the intermediate heat exchanger 15*a* and the intermediate heat exchanger 15*b*. That is, in the air-conditioning apparatus 100, the heat source-side refrigerant that circulates through the refrigerant circuit A, and the heat medium that circulates through the heat medium circuit B exchange heat in the intermediate heat exchanger 15*a* and the intermediate heat exchanger 15*b*.

[Description of Operation Modes]

Next, various operation modes executed by the air-conditioning apparatus 100 will be described. In the air-conditioning apparatus 100, on the basis of instruction from each indoor unit 2, a cooling operation or a heating operation is possible in the corresponding indoor unit 2. That is, the air-conditioning apparatus 100 allows all of the indoor units 2 to execute the same operation, and also allows the individual indoor units 2 to execute different operations.

Operation modes executed by the air-conditioning apparatus 100 include a cooling only operation mode in which all of the indoor units 2 being driven to execute a cooling operation, a heating operation mode in which all of the indoor units 2 being driven to execute only a heating operation, a cooling main operation mode as a cooling and heating mixed operation mode in which the cooling load is greater, and a heating main operation mode as a cooling and heating mixed operation mode in which the heating load is greater. Hereinafter, each of the operation modes will be described together with the corresponding flows of the heat source-side refrigerant and heat medium.

[Cooling Only Operation Mode]

Figure 2:
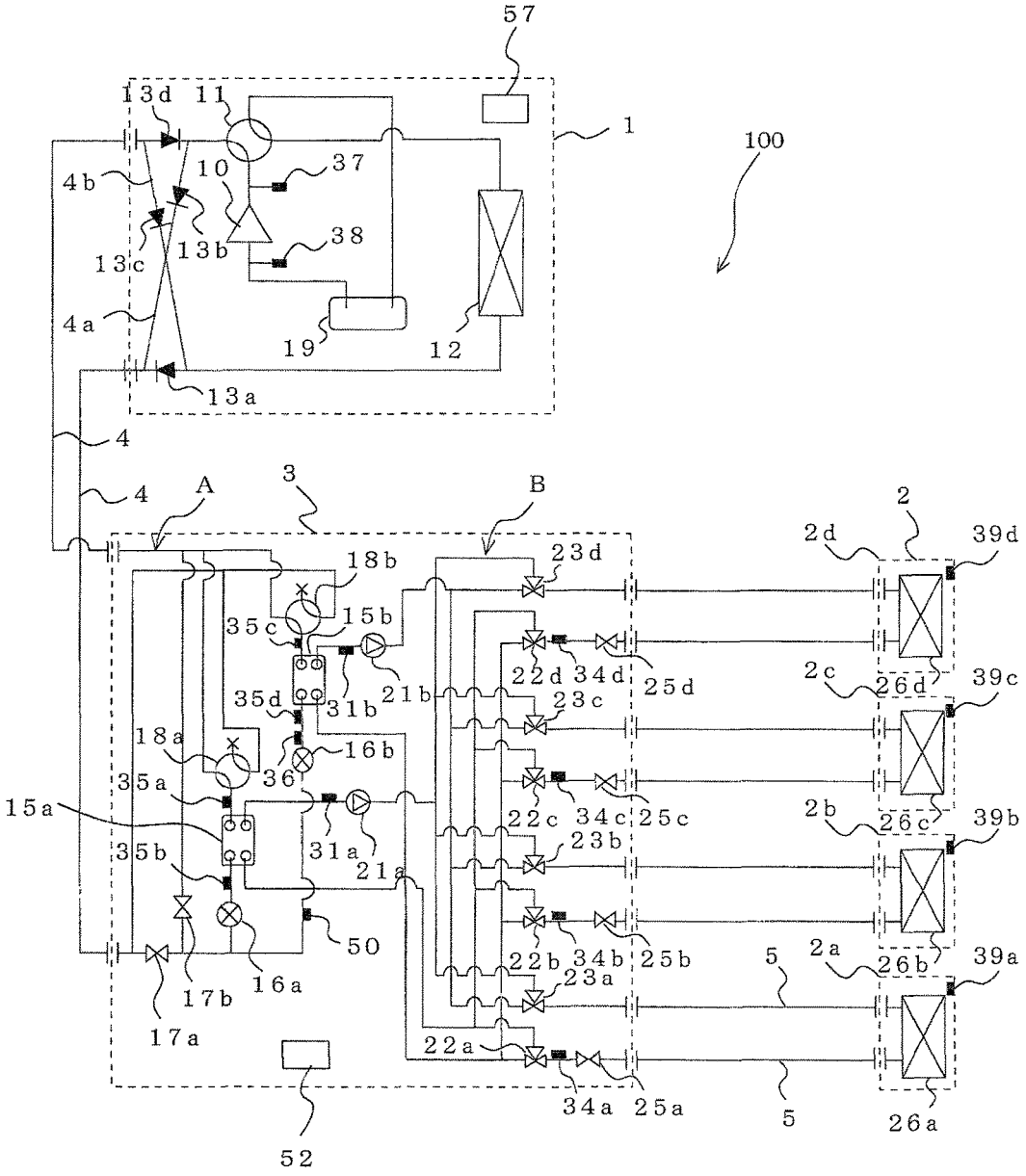
FIG. 2 is a refrigerant circuit configuration example of the air-conditioning apparatus according to Embodiment of the present invention.
Figure 3:
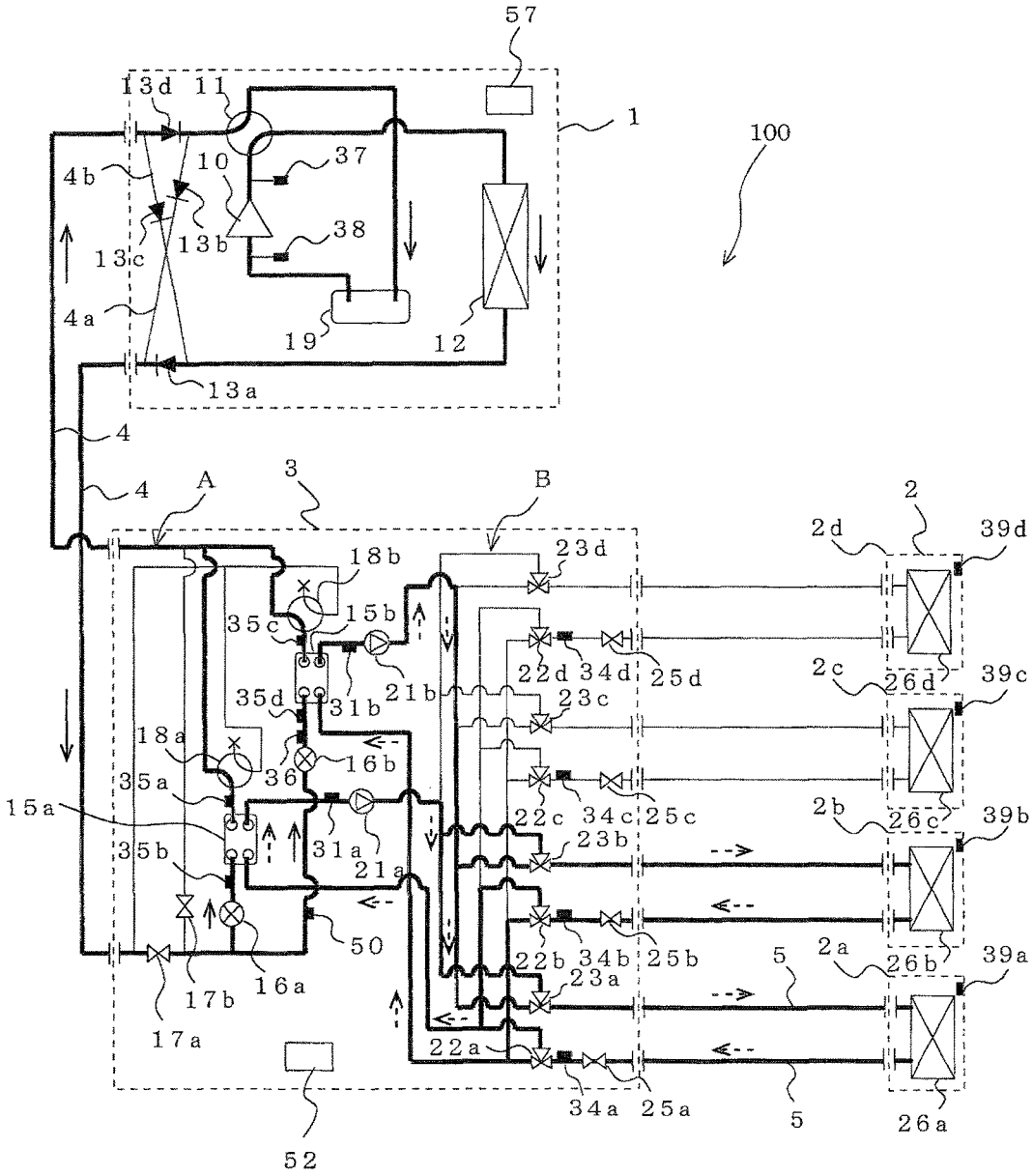
FIG. 3 is a refrigerant circuit diagram illustrating the flow of refrigerant in a cooling only operation mode of an air-conditioning apparatus illustrated in FIG. 2.

FIG. 3 is a refrigerant circuit diagram illustrating the flow of refrigerant in the cooling only operation mode of the air-conditioning apparatus 100 illustrated in FIG. 2. In FIG. 3, the cooling only operation mode will be described with respect to a case where a cooling load is generated only in the use-side heat exchanger 26*a* and the use-side heat exchanger 26*b* by way of example. In FIG. 3, pipes indicated by thick lines represent pipes through which the refrigerants (the heat source-side refrigerant and the heat medium) flow. In FIG. 3, the flow direction of the heat source-side refrigerant is indicated by solid arrows, and the flow direction of the heat medium is indicated by broken arrows.

In the case of the cooling only operation mode illustrated in FIG. 3, in the outdoor unit 1, the first refrigerant flow switching device 11 is switched so as to cause the heat source-side refrigerant discharged from the compressor 10 to enter the heat source-side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed, so that the heat medium circulates between each of the intermediate heat exchanger 15*a* and the intermediate heat exchanger 15*b*, and both the use-side heat exchanger 26*a* and the use-side heat exchanger 26*b*.

First, the flow of the heat source-side refrigerant in the refrigerant circuit A will be described.

A low-temperature/low-pressure refrigerant is compressed by the compressor 10, and discharged as a high-temperature/high-pressure gas refrigerant. The high-temperature/high-pressure gas refrigerant discharged from the compressor 10 enters the heat source-side heat exchanger 12 via the first refrigerant flow switching device 11. Then, in the heat source-side heat exchanger 12, the high-temperature/high-pressure gas refrigerant turns into a high-pressure liquid refrigerant while rejecting heat to the outdoor air. The high-pressure refrigerant that has exited the heat source-side heat exchanger 12 passes through the check valve 13*a* and exits the outdoor unit 1, and then passes through the refrigerant pipe 4 and enters the heat medium relay unit 3. The high-pressure refrigerant that has entered the heat medium relay unit 3 is divided into branch flows after passing through the opening and closing device 17*a*, which are respectively expanded in the expansion device 16*a* and the expansion device 16*b* and each turn into a low-temperature/low-pressure two-phase refrigerant. The opening and closing device 17*b* is closed at this time.

The respective flows of two-phase refrigerant enter the intermediate heat exchanger 15*a* and the intermediate heat exchanger 15*b* each acting as an evaporator, and each turn into a low-temperature/low-pressure gas refrigerant while cooling the heat medium by removing heat from the heat medium circulating through the heat medium circuit B. The respective flows of gas refrigerant that have exited the intermediate heat exchanger 15*a* and the intermediate heat exchanger 15*b* exit the heat medium relay unit 3 via the second refrigerant flow switching device 18*a* and the second refrigerant flow switching device 18*b*, respectively, pass through the refrigerant pipe 4, and enter the outdoor unit 1 again. The refrigerant that has entered the outdoor unit 1 passes through the check valve 13*d*, and is sucked into the compressor 10 again via the first refrigerant flow switching device 11 and the accumulator 19.

At this time, the second refrigerant flow switching device 18*a* and the second refrigerant flow switching device 18*b* each communicate with a low-pressure pipe. In addition, the opening degree of the expansion device 16*a* is controlled so that the superheat (degree of superheat) obtained as the difference between the temperature detected by the third temperature sensor 35*a* and the temperature detected by the third temperature sensor 35*b* becomes constant. Likewise, the opening degree of the expansion device 16*b* is controlled so that the superheat obtained as the difference between the temperature detected by the third temperature sensor 35*c* and the temperature detected by the third temperature sensor 35*d* becomes constant.

Next, the flow of the heat medium in the heat medium circuit B will be described.

In the cooling only operation mode, the cooling energy of the heat source-side refrigerant is transferred to the heat medium in both the intermediate heat exchanger 15*a* and the intermediate heat exchanger 15*b*, and the cooled heat medium is caused to flow within the pipe 5 by the pump 21*a* and the pump 21*b*. The flows of the heat medium that have been pressurized by and have exited the pump 21*a* and the pump 21*b* enter the use-side heat exchanger 26*a* and the use-side heat exchanger 26*b* via the second heat medium flow switching device 23*a* and the second heat medium flow switching device 23*b*, respectively. Then, the indoor space 7 is cooled as the heat medium removes heat from the indoor air in each of the use-side heat exchanger 26*a* and the use-side heat exchanger 26*b*.

Thereafter, the flows of heat medium exit the use-side heat exchanger 26*a* and the use-side heat exchanger 26*b* and enter the heat medium flow control device 25*a* and the heat medium flow control device 25*b*, respectively. At this time, the flows of heat medium have their flow rate controlled by the action of the heat medium flow control device 25*a* and the heat medium flow control device 25*b* to a flow rate required to provide the air conditioning load that is required indoors, before entering the use-side heat exchanger 26*a* and the use-side heat exchanger 26*b*, respectively. The flows of heat medium that have exited the heat medium flow control device 25*a* and the heat medium flow control device 25*b* enter the intermediate heat exchanger 15*a* and the intermediate heat exchanger 15*b* via the first heat medium flow switching device 22*a* and the first heat medium flow switching device 22*b*, and are sucked into the pump 21*a* and the pump 21*b* again, respectively.

Within the pipe 5 of the use-side heat exchanger 26, the heat medium flows in such a direction that the heat medium reaches the first heat medium flow switching device 22 from the second heat medium flow switching device 23 via the heat medium flow control device 25. Further, the air conditioning load required in the indoor space 7 can be provided by controlling the difference between the temperature detected by the first temperature sensor 31*a* or the temperature detected by the first temperature sensor 31*b*, and the temperature detected by the corresponding second temperature sensor 34 so as to maintain the difference at a target value. As the outlet temperature of the intermediate heat exchanger 15, the temperature from either the first temperature sensor 31*a* or the first temperature sensor 31*b* may be used, or the average temperature of these temperatures may be used. At this time, the first heat medium flow switching device 22 and the second heat medium flow switching device 23 are each controlled to an intermediate opening degree so as to secure flow paths leading to both the intermediate heat exchanger 15*a* and the intermediate heat exchanger 15*b*.

When executing the cooling only operation mode, there is no need to pass the heat medium to the use-side heat exchanger 26 in which no heat load exists (including thermo-OFF). Accordingly, the flow path to the corresponding use-side heat exchanger 26 is closed by the heat medium flow control device 25 so that the heat medium does not flow to the use-side heat exchanger 26. In FIG. 3, while a heat load exists in the use-side heat exchanger 26*a* and the use-side heat exchanger 26*b* and hence the heat medium is passed to these heat exchangers, no heat load exists in the use-side heat exchanger 26*c* and the use-side heat exchanger 26*d*, and hence the corresponding heat medium flow control device 25*c* and heat medium flow control device 25*d* are fully closed. Then, when a heat load is generated from the use-side heat exchanger 26*c* or the use-side heat exchanger 26*d*, the heat medium flow control device 25*c* or the heat medium flow control device 25*d* may be opened to circulate the heat medium.

The refrigerant at the position of the fourth temperature sensor 50 is a liquid refrigerant. Liquid inlet enthalpy can be computed by the controller 52 on the basis of temperature information on this refrigerant. In addition, the temperature of the refrigerant in a low-pressure, two-phase state can be detected from the third temperature sensor 35*d*, and on the basis of this temperature information, saturated liquid enthalpy and saturated gas enthalpy can be computed by the controller 52.

[Heating Only Operation Mode]

Figure 4:
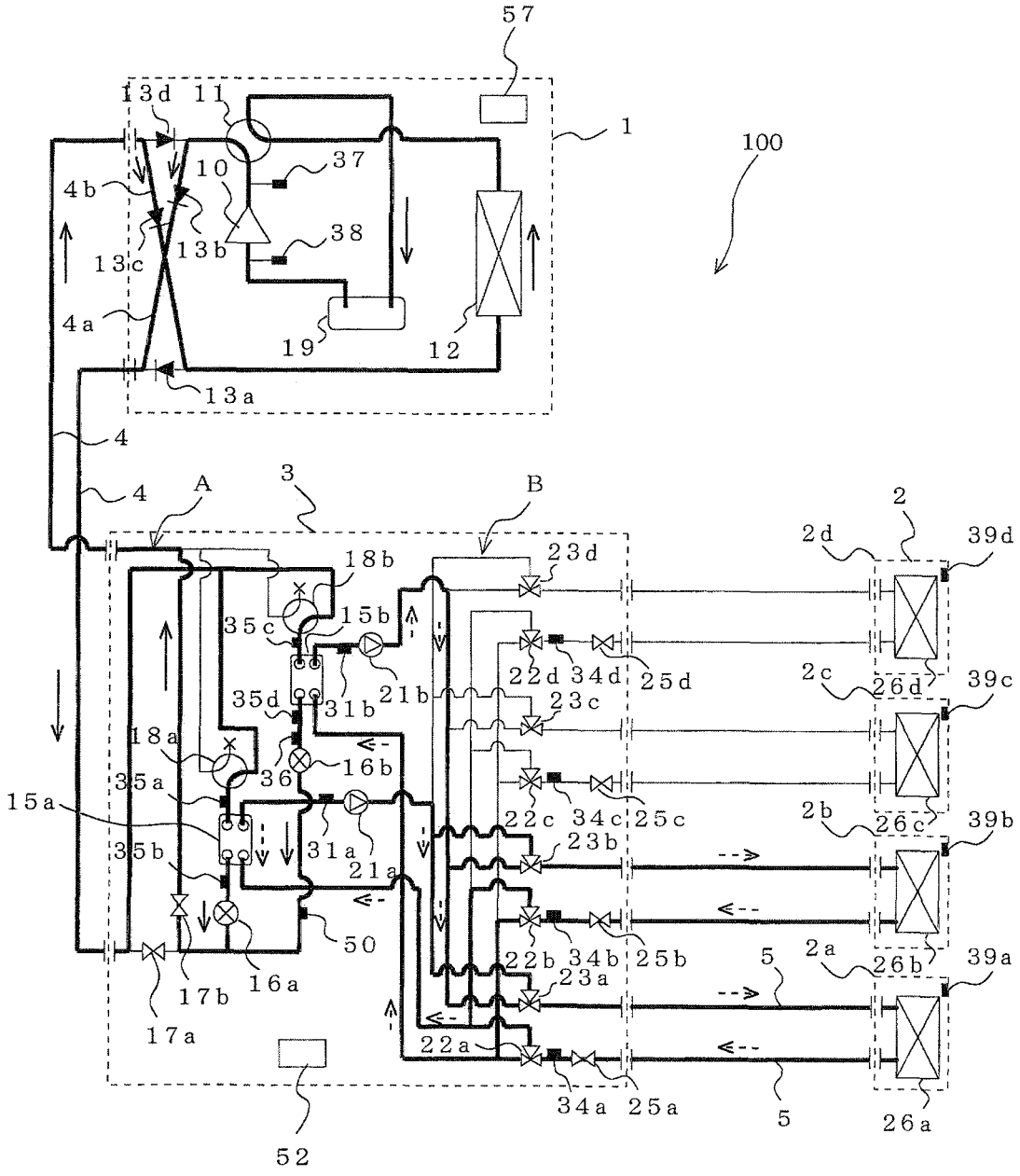
FIG. 4 is a refrigerant circuit diagram illustrating the flow of refrigerant in a heating only operation mode of the air-conditioning apparatus illustrated in FIG. 2.

FIG. 4 is a refrigerant circuit diagram illustrating the flow of refrigerant in the heating only operation mode of the air-conditioning apparatus 100. In FIG. 4, the heating only operation mode will be described with respect to a case where a heating load is generated in only the use-side heat exchanger 26*a* and the use-side heat exchanger 26*b* by way of example. In FIG. 4, pipes indicated by thick lines represent pipes through which the refrigerants (the heat source-side refrigerant and the heat medium) flow. In FIG. 4, the flow direction of the heat source-side refrigerant is indicated by solid arrows, and the flow direction of the heat medium is indicated by broken arrows.

In the case of the heating only operation mode illustrated in FIG. 4, in the outdoor unit 1, the first refrigerant flow switching device 11 is switched so as to cause the heat source-side refrigerant discharged from the compressor 10 to enter the heat medium relay unit 3 without passing through the heat source-side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed, so that the heat medium circulates between each of the intermediate heat exchanger 15*a* and the intermediate heat exchanger 15*b*, and both the use-side heat exchanger 26*a* and the use-side heat exchanger 26*b*.

First, the flow of the heat source-side refrigerant in the refrigerant circuit A will be described.

A low-temperature/low-pressure refrigerant is compressed by the compressor 10, and discharged as a high-temperature/high-pressure gas refrigerant. The high-temperature/high-pressure gas refrigerant discharged from the compressor 10 passes through the first refrigerant flow switching device 11 and the check valve 13*b*, and exits the outdoor unit 1. The high-temperature/high-pressure gas refrigerant that has exited the outdoor unit 1 passes through the refrigerant pipe 4 and enters the heat medium relay unit 3. The high-temperature/high-pressure gas refrigerant that has entered the heat medium relay unit 3 is divided into branch flows, which pass through the second refrigerant flow switching device 18*a* and the second refrigerant flow switching device 18*b* and enter the intermediate heat exchanger 15*a* and the intermediate heat exchanger 15*b*, respectively.

The flows of high-temperature/high-pressure gas refrigerant that have entered the intermediate heat exchanger 15*a* and the intermediate heat exchanger 15*b* each turn into a high-pressure liquid refrigerant while rejecting heat to the heat medium circulating through the heat medium circuit B. The flows of liquid refrigerant that have exited the intermediate heat exchanger 15*a* and the intermediate heat exchanger 15*b* are expanded in the expansion device 16*a* and the expansion device 16*b*, respectively, and each turn into a low-temperature/low-pressure two-phase refrigerant. This two-phase refrigerant exits the heat medium relay unit 3 after passing through the opening and closing device 17*b*, and passes through the refrigerant pipe 4 to enter the outdoor unit 1 again. The opening and closing device 17*a* is closed at this time.

The refrigerant that has entered the outdoor unit 1 passes through the check valve 13*c*, and enters the heat source-side heat exchanger 12 that acts as an evaporator. Then, the refrigerant that has entered the heat source-side heat exchanger 12 removes heat from the outdoor air in the heat source-side heat exchanger 12, and turns into a low-temperature/low-pressure gas refrigerant. The low-temperature/low-pressure gas refrigerant that has exited the heat source-side heat exchanger 12 is sucked into the compressor 10 again via the first refrigerant flow switching device 11 and the accumulator 19.

At this time, the second refrigerant flow switching device 18*a* and the second refrigerant flow switching device 18*b* each communicate with a high-pressure pipe. In addition, the opening degree of the expansion device 16*a* is controlled so that the subcooling (degree of subcooling) obtained as the difference between a value obtained by converting the pressure detected by the first pressure sensor 36 into a saturation temperature, and the temperature detected by the third temperature sensor 35*b* becomes constant. Likewise, the opening degree of the expansion device 16*b* is controlled so that the subcooling obtained as the difference between a value obtained by converting the pressure detected by the first pressure sensor 36 into a saturation temperature, and the temperature detected by the third temperature sensor 35*d* becomes constant. In a case where the temperature at the intermediate position of the intermediate heat exchanger 15 can be measured, the temperature at the intermediate position may be used instead of the first pressure sensor 36, in which case the system can be configured inexpensively.

Next, the flow of the heat medium in the heat medium circuit B will be described.

In the heating only operation mode, the heating energy of the heat source-side refrigerant is transferred to the heat medium in both the intermediate heat exchanger 15*a* and the intermediate heat exchanger 15*b*, and the heated heat medium is caused to flow within the pipe 5 by the pump 21*a* and the pump 21*b*. The flows of the heat medium that have been pressurized by and have exited the pump 21*a* and the pump 21*b* enter the use-side heat exchanger 26*a* and the use-side heat exchanger 26*b* via the second heat medium flow switching device 23*a* and the second heat medium flow switching device 23*b*, respectively. Then, the indoor space 7 is heated as the heat medium rejects heat to the indoor air in each of the use-side heat exchanger 26*a* and the use-side heat exchanger 26*b*.

Thereafter, the flows of heat medium exit the use-side heat exchanger 26*a* and the use-side heat exchanger 26*b* and enter the heat medium flow control device 25*a* and the heat medium flow control device 25*b*, respectively. At this time, the flows of heat medium have their flow rate controlled by the action of the heat medium flow control device 25*a* and the heat medium flow control device 25*b* to a flow rate required to provide the air conditioning load that is required indoors, before entering the use-side heat exchanger 26*a* and the use-side heat exchanger 26*b*, respectively. The flows of heat medium that have exited the heat medium flow control device 25*a* and the heat medium flow control device 25*b* enter the intermediate heat exchanger 15*a* and the intermediate heat exchanger 15*b* via the first heat medium flow switching device 22*a* and the first heat medium flow switching device 22*b*, and are sucked into the pump 21*a* and the pump 21*b* again, respectively.

Within the pipe 5 of the use-side heat exchanger 26, the heat medium flows in such a direction that the heat medium reaches the first heat medium flow switching device 22 from the second heat medium flow switching device 23 via the heat medium flow control device 25. Further, the air conditioning load required in the indoor space 7 can be provided by controlling the difference between the temperature detected by the first temperature sensor 31*a* or the temperature detected by the first temperature sensor 31*b*, and the temperature detected by the corresponding second temperature sensor 34 so as to maintain the difference at a target value. As the outlet temperature of the intermediate heat exchanger 15, the temperature from either the first temperature sensor 31*a* or the first temperature sensor 31*b* may be used, or the average temperature of these temperatures may be used.

At this time, the first heat medium flow switching device 22 and the second heat medium flow switching device 23 are each controlled to an intermediate opening degree so as to secure flow paths leading to both the intermediate heat exchanger 15*a* and the intermediate heat exchanger 15*b*. While the use-side heat exchanger 26 should normally be controlled on the basis of the temperature difference between its inlet and outlet, the heat medium temperature on the inlet side of the use-side heat exchanger 26 is substantially the same temperature as the temperature detected by the first temperature sensor 31*b*. Accordingly, by using the first temperature sensor 31*b*, the number of temperature sensors can be reduced, and the system can be configured inexpensively.

When executing the heating only operation mode, there is no need to pass the heat medium to the use-side heat exchanger 26 in which no heat load exists (including thermo-OFF). Accordingly, the flow path to the corresponding use-side heat exchanger 26 is closed by the heat medium flow control device 25 so that the heat medium does not flow to the use-side heat exchanger 26. In FIG. 4, while a heat load exists in the use-side heat exchanger 26*a* and the use-side heat exchanger 26*b* and hence the heat medium is passed to these heat exchangers, no heat load exists in the use-side heat exchanger 26*c* and the use-side heat exchanger 26*d*, and hence the corresponding heat medium flow control device 25*c* and heat medium flow control device 25*d* are fully closed. Then, when a heat load is generated from the use-side heat exchanger 26*c* or the use-side heat exchanger 26*d*, the heat medium flow control device 25*c* or the heat medium flow control device 25*d* may be opened to circulate the heat medium.

[Cooling Main Operation Mode]

Figure 5:
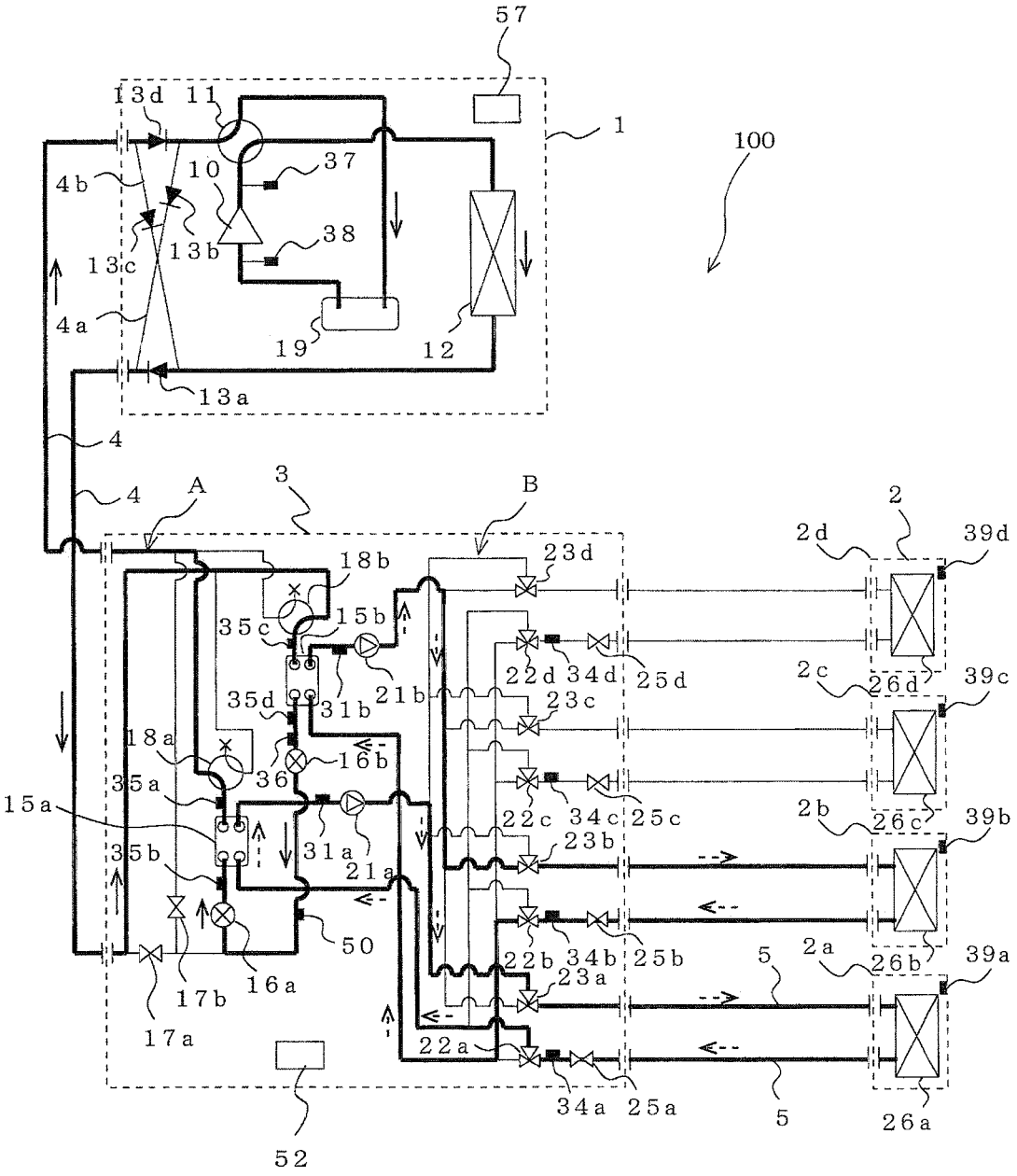
FIG. 5 is a refrigerant circuit diagram illustrating the flow of refrigerant in a cooling main operation mode of the air-conditioning apparatus illustrated in FIG. 2.

FIG. 5 is a refrigerant circuit diagram illustrating the flow of refrigerant in the cooling main operation mode of the air-conditioning apparatus illustrated in FIG. 2. In FIG. 5, the cooling main operation mode will be described with respect to a case where a cooling load is generated in the use-side heat exchanger 26*a* and a heating load is generated in the use-side heat exchanger 26*b* by way of example. In FIG. 5, pipes indicated by thick lines represent pipes through which the refrigerant (the heat source-side refrigerant and the heat medium) circulates. In FIG. 5, the flow direction of the heat source-side refrigerant is indicated by solid arrows, and the flow direction of the heat medium is indicated by broken arrows.

In the case of the cooling main operation mode illustrated in FIG. 5, in the outdoor unit 1, the first refrigerant flow switching device 11 is switched so as to cause the heat source-side refrigerant discharged from the compressor 10 to enter the heat source-side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed, so that the heat medium circulates between the intermediate heat exchanger 15*a* and the use-side heat exchanger 26*a*, and between the intermediate heat exchanger 15*b* and the use-side heat exchanger 26*b*.

First, the flow of the heat source-side refrigerant in the refrigerant circuit A will be described.

A low-temperature/low-pressure refrigerant is compressed by the compressor 10, and discharged as a high-temperature/high-pressure gas refrigerant. The high-temperature/high-pressure gas refrigerant discharged from the compressor 10 enters the heat source-side heat exchanger 12 via the first refrigerant flow switching device 11. Then, in the heat source-side heat exchanger 12, the high-temperature/high-pressure gas refrigerant turns into a liquid refrigerant while rejecting heat to the outdoor air. The refrigerant that has exited the heat source-side heat exchanger 12 exits the outdoor unit 1, passes through the check valve 13*a* and the refrigerant pipe 4, and enters the heat medium relay unit 3. The refrigerant that has entered the heat medium relay unit 3 passes through the second refrigerant flow switching device 18*b*, and enters the intermediate heat exchanger 15*b* that acts as a condenser.

The refrigerant that has entered the intermediate heat exchanger 15*b* further decreases in temperature while rejecting heat to the heat medium circulating through the heat medium circuit B. The refrigerant that has exited the intermediate heat exchanger 15*b* is expanded in the expansion device 16*b* and turns into a low-pressure two-phase refrigerant. This low-pressure two-phase refrigerant enters the intermediate heat exchanger 15*a* acting as an evaporator via the expansion device 16*a*. The low-pressure two-phase refrigerant that has entered the intermediate heat exchanger 15*a* turns into a low-pressure gas refrigerant while cooling the heat medium by removing heat from the heat medium circulating through the heat medium circuit B. This gas refrigerant exits the intermediate heat exchanger 15*a*, exits the heat medium relay unit 3 via the second refrigerant flow switching device 18*a*, passes thought the refrigerant pipe 4, and enters the outdoor unit 1 again. The refrigerant that has entered the outdoor unit 1 passes through the check valve 13*d*, and is sucked into the compressor 10 again via the first refrigerant flow switching device 11 and the accumulator 19.

At this time, the second refrigerant flow switching device 18*a* communicates with a low-pressure pipe, and the second refrigerant flow switching device 18*b* communicates with a high-pressure side pipe. In addition, the opening degree of the expansion device 16*b* is controlled so that the superheat obtained as the difference between the temperature detected by the third temperature sensor 35*a* and the temperature detected by the third temperature sensor 35*b* becomes constant. Further, the expansion device 16*a* is fully open, and the opening devices 17*a* and 17*b* are fully closed at this time. Alternatively, the opening degree of the expansion device 16*b* may be controlled so that the subcooling, which is obtained as the difference between a value obtained by converting the pressure detected by the first pressure sensor 36 into a saturation temperature, and the temperature detected by the third temperature sensor 35*d*, becomes constant. Alternatively, the expansion device 16*b* may be fully opened, and the superheat or subcooling may be controlled by the expansion device 16*a*.

Next, the flow of the heat medium in the heat medium circuit B will be described.

In cooling main operation mode, the heating energy of the heat source-side refrigerant is transferred to the heat medium in the intermediate heat exchanger 15*b*, and the heated heat medium is caused to flow within the pipe 5 by the pump 21*b*. Further, in the cooling main operation mode, the cooling energy of the heat source-side refrigerant is transferred to the heat medium in the intermediate heat exchanger 15*a*, and the cooled heat medium is caused to flow within the pipe 5 by the pump 21*a*. The cooled heat medium that has been pressurized by and has exited the pump 21*a* enters the use-side heat exchanger 26*a* via the second heat medium flow switching device 23*a*. The heated heat medium that has been pressurized by and has exited the pump 21*b* enters the use-side heat exchanger 26*b* via the second heat medium flow switching device 23*b*.

In the use-side heat exchanger 26*b*, the indoor space 7 is heated as the heat medium rejects heat to the indoor air. Further, in the use-side heat exchanger 26*a*, the indoor space 7 is cooled as the heat medium removes heat from the indoor air. At this time, the respective flows of heat medium enter the use-side heat exchanger 26*a* and the use-side heat exchanger 26*b* after having their flow rate controlled by the action of the heat medium flow control device 25*a* and the heat medium flow control device 25*b* to a flow rate required to provide the air conditioning load that is required indoors. The heat medium that has passed through the use-side heat exchanger 26*b* and whose temperature has slightly dropped passes through the heat medium flow control device 25*b* and the first heat medium flow switching device 22*b*, enters the intermediate heat exchanger 15*b*, and is sucked into the pump 21*b* again. The heat medium that has passed through the use-side heat exchanger 26*a* and whose temperature has slightly risen passes through the heat medium flow control device 25*a* and the first heat medium flow switching device 22*a*, enters the intermediate heat exchanger 15*a*, and is sucked into the pump 21*a* again.

In the meantime, the warm heat medium and the cold heat medium are introduced to the use-side heat exchanger 26 in which a heating load exists and the use-side heat exchanger 26 in which a cooling load exists, respectively, without mixing together, by the action of the first heat medium flow switching device 22 and the second heat medium flow switching device 23. Within the pipe 5 of the use-side heat exchanger 26, on both the heating side and the cooling side, the heat medium flows in a such a direction that the heat medium reaches the first heat medium flow switching device 22 from the second heat medium flow switching device 23 via the heat medium flow control device 25. Further, the air conditioning load required in the indoor space 7 can be provided by controlling, on the heating side, the difference between the temperature detected by the first temperature sensor 31*b* and the temperature detected by the corresponding second temperature sensor 34, and by controlling, on the cooling side, the difference between the temperature detected by the corresponding second temperature sensor 34 and the temperature detected by the first temperature sensor 31*a*, so as to maintain the difference at a target value.

When executing the cooling main operation mode, there is no need to pass the heat medium to the use-side heat exchanger 26 in which no heat load exists (including thermo-OFF). Accordingly, the flow path to the corresponding use-side heat exchanger 26 is closed by the heat medium flow control device 25 so that the heat medium does not flow to the use-side heat exchanger 26. In FIG. 5, while a heat load exists in the use-side heat exchanger 26*a* and the use-side heat exchanger 26*b* and hence the heat medium is passed to these heat exchangers, no heat load exists in the use-side heat exchanger 26*c* and the use-side heat exchanger 26*d*, and hence the corresponding heat medium flow control device 25*c* and heat medium flow control device 25*d* are fully closed. Then, when a heat load is generated from the use-side heat exchanger 26*c* or the use-side heat exchanger 26*d*, the heat medium flow control device 25*c* or the heat medium flow control device 25*d* may be opened to circulate the heat medium.

[Heating Main Operation Mode]

Figure 6:
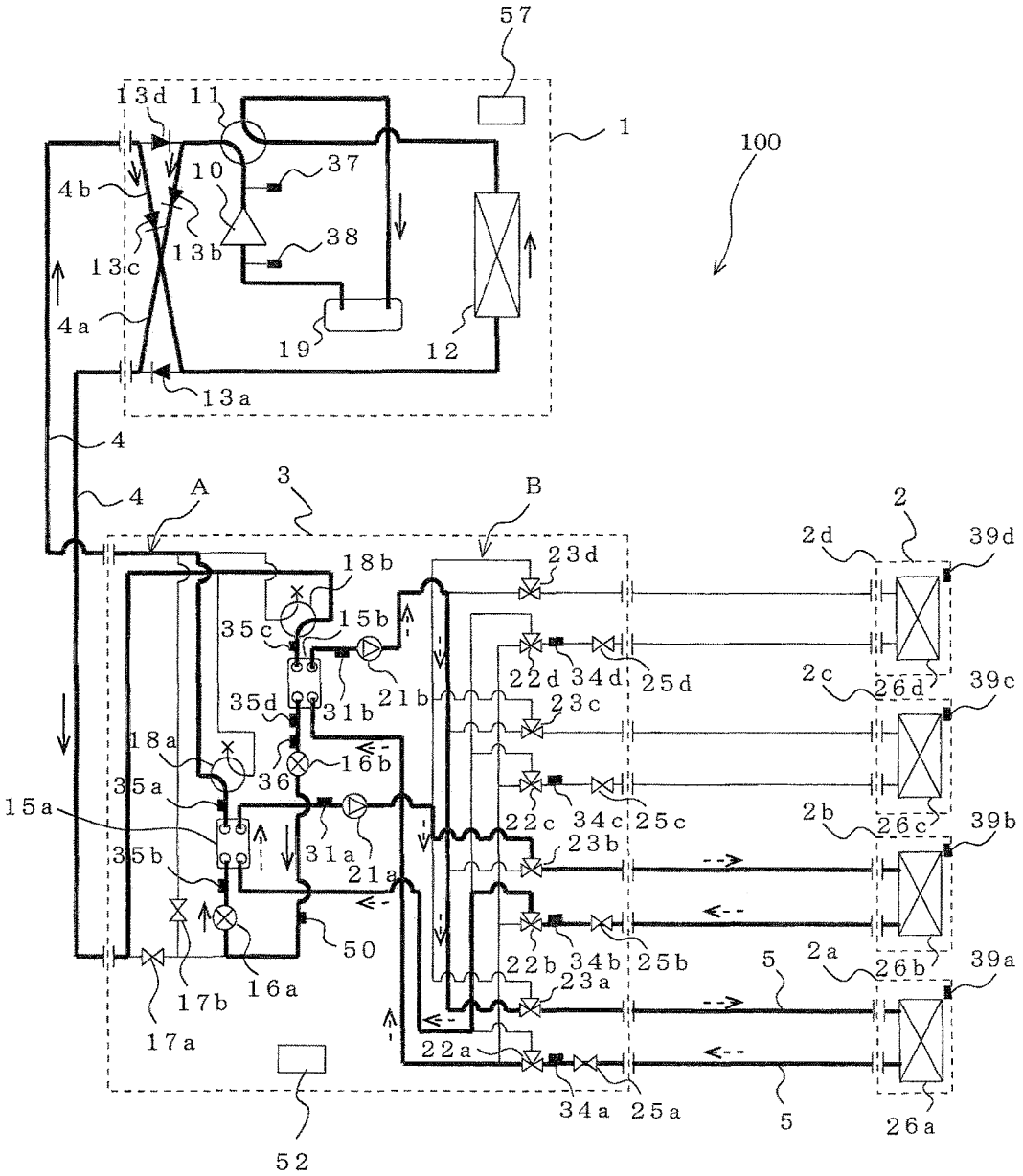
FIG. 6 is a refrigerant circuit diagram illustrating the flow of refrigerant in a heating main operation mode of the air-conditioning apparatus illustrated in FIG. 2.

FIG. 6 is a refrigerant circuit diagram illustrating the flow of refrigerant in the heating main operation mode of the air-conditioning apparatus 100 illustrated in FIG. 2. In FIG. 6, the heating main operation mode will be described with respect to a case where a heating load is generated in the use-side heat exchangers 26*a*, and a cooling load is generated in the use-side heat exchanger 26*b* by way of example. In FIG. 6, pipes indicated by thick lines represent pipes through which the refrigerants (the heat source-side refrigerant and the heat medium) circulate. In FIG. 6, the flow direction of the heat source-side refrigerant is indicated by solid arrows, and the flow direction of the heat medium is indicated by broken arrows.

In the case of the heating main operation mode illustrated in FIG. 6, in the outdoor unit 1, the first refrigerant flow switching device 11 is switched so as to cause the heat source-side refrigerant discharged from the compressor 10 to enter the heat medium relay unit 3 without passing through the heat source-side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed, so that the heat medium circulates between the intermediate heat exchanger 15*a* and the use-side heat exchanger 26*b*, and between the intermediate heat exchanger 15*b* and the use-side heat exchanger 26*a*.

First, the flow of the heat source-side refrigerant in the refrigerant circuit A will be described.

A low-temperature/low-pressure refrigerant is compressed by the compressor 10, and discharged as a high-temperature/high-pressure gas refrigerant. The high-temperature/high-pressure gas refrigerant discharged from the compressor 10 passes through the first refrigerant flow switching device 11 and the check valve 13*b*, and exits the outdoor unit 1. The high-temperature/high-pressure gas refrigerant that has exited the outdoor unit 1 passes through the refrigerant pipe 4 and enters the heat medium relay unit 3. The high-temperature/high-pressure gas refrigerant that has entered the heat medium relay unit 3 passes through the second refrigerant flow switching device 18*b*, and enters the intermediate heat exchanger 15*b* that acts as a condenser.

The gas refrigerant that has entered the intermediate heat exchanger 15*b* turns into a liquid refrigerant while rejecting heat to the heat medium circulating through the heat medium circuit B. The refrigerant that has exited the intermediate heat exchanger 15*b* is expanded in the expansion device 16*b* and turns into a low-pressure two-phase refrigerant. This low-pressure two-phase refrigerant enters the intermediate heat exchanger 15*a* acting as an evaporator via the expansion device 16*a*. The low-pressure two-phase refrigerant that has entered the intermediate heat exchanger 15*a* evaporates as the refrigerant removes heat from the heat medium circulating through the heat medium circuit B, thereby cooling the heat medium. This low-pressure two-phase refrigerant exits the intermediate heat exchanger 15*a*, exits the heat medium relay unit 3 via the second refrigerant flow switching device 18*a*, and enters the outdoor unit 1 again.

The refrigerant that has entered the outdoor unit 1 passes through the check valve 13*c*, and enters the heat source-side heat exchanger 12 that acts as an evaporator. Then, the refrigerant that has entered the heat source-side heat exchanger 12 removes heat from the outdoor air in the heat source-side heat exchanger 12, and turns into a low-temperature/low-pressure gas refrigerant. The low-temperature/ low-pressure gas refrigerant that has exited the heat source-side heat exchanger 12 is sucked into the compressor 10 again via the first refrigerant flow switching device 11 and the accumulator 19.

At this time, the second refrigerant flow switching device 18*a* communicates with a low-pressure side pipe, and the second refrigerant flow switching device 18*b* communicates with a high pressure-side pipe. In addition, the opening degree of the expansion device 16*b* is controlled so that the subcooling, which is obtained as the difference between a value obtained by converting the pressure detected by the first pressure sensor 36 into a saturation temperature, and the temperature detected by the third temperature sensor 35*b*, becomes constant. At this time, the expansion device 16*a* is fully open, and the opening devices 17*a* and 17*b* are closed. Alternatively, the expansion device 16*b* may be fully opened, and the subcooling may be controlled by the expansion device 16*a*.

Next, the flow of the heat medium in the heat medium circuit B will be described.

In the heating main operation mode, the heating energy of the heat source-side refrigerant is transferred to the heat medium in the intermediate heat exchanger 15*b*, and the heated heat medium is caused to flow within the pipe 5 by the pump 21*b*. Further, in the heating main operation mode, the cooling energy of the heat source-side refrigerant is transferred to the heat medium in the intermediate heat exchanger 15*a*, and the cooled heat medium is caused to flow within the pipe 5 by the pump 21*a*. The heated heat medium that has been pressurized by and has exited the pump 21*b* enters the use-side heat exchanger 26*a* via the second heat medium flow switching device 23*a*. The cooled heat medium that has been pressurized by and has exited the pump 21*a* enters the use-side heat exchanger 26*b* via the second heat medium flow switching device 23*b*.

In the use-side heat exchanger 26*a*, the indoor space 7 is heated as the heat medium rejects heat to the indoor air. Further, in the use-side heat exchanger 26*b*, the indoor space 7 is cooled as the heat medium removes heat from the indoor air. At this time, the respective flows of heat medium enter the use-side heat exchanger 26*a* and the use-side heat exchanger 26*b* after having their flow rate controlled by the action of the heat medium flow control device 25*a* and the heat medium flow control device 25*b* to a flow rate required to provide the air conditioning load that is required indoors. The heat medium that has passed through the use-side heat exchanger 26*b* and whose temperature has slightly risen passes through the heat medium flow control device 25*b* and the first heat medium flow switching device 22*b*, enters the intermediate heat exchanger 15*a*, and is sucked into the pump 21*a* again. The heat medium that has passed through the use-side heat exchanger 26*a* and whose temperature has slightly dropped passes through the heat medium flow control device 25*a* and the first heat medium flow switching device 22*a*, enters the intermediate heat exchanger 15*b*, and is sucked into the pump 21*b* again.

In the meantime, the warm heat medium and the cold heat medium are introduced to the use-side heat exchanger 26 in which a heating load exists and the use-side heat exchanger 26 in which a cooling load exists, respectively, without mixing together, by the action of the first heat medium flow switching device 22 and the second heat medium flow switching device 23. Within the pipe 5 of the use-side heat exchanger 26, on both the heating side and the cooling side, the heat medium flows in a such a direction that the heat medium reaches the first heat medium flow switching device 22 from the second heat medium flow switching device 23 via the heat medium flow control device 25. Further, the air conditioning load required in the indoor space 7 can be provided by controlling, on the heating side, the difference between the temperature detected by the first temperature sensor 31*b* and the temperature detected by the corresponding second temperature sensor 34, and by controlling, on the cooling side, the difference between the temperature detected by the corresponding second temperature sensor 34 and the temperature detected by the first temperature sensor 31*a*, so as to maintain the difference at a target value.

When executing the heating main operation mode, there is no need to pass the heat medium to the use-side heat exchanger 26 in which no heat load exists (including thermo-OFF). Accordingly, the flow path to the corresponding use-side heat exchanger 26 is closed by the heat medium flow control device 25 so that the heat medium does not flow to the use-side heat exchanger 26. In FIG. 6, while a heat load exists in the use-side heat exchanger 26*a* and the use-side heat exchanger 26*b* and hence the heat medium is passed to these heat exchangers, no heat load exists in the use-side heat exchanger 26*c* and the use-side heat exchanger 26*d*, and hence the corresponding heat medium flow control device 25*c* and heat medium flow control device 25*d* are fully closed. Then, when a heat load is generated from the use-side heat exchanger 26*c* or the use-side heat exchanger 26*d*, the heat medium flow control device 25*c* or the heat medium flow control device 25*d* may be opened to circulate the heat medium.

[Refrigerant Pipe 4]

As has been described above, in various operation modes executed by the air-conditioning apparatus 100 according to Embodiment 1, the heat source-side refrigerant flows in the refrigerant pipe 4 that connects the outdoor unit 1 and the heat medium relay unit 3.

[Pipe 5]

In various operation modes executed by the air-conditioning apparatus 100 according to Embodiment 1, the heat medium such as water or antifreeze flows through the pipe 5 that connects the heat medium relay unit 3 and the indoor unit 2.

[Heat Medium]

As the heat medium, for example, brine (antifreeze) or water, a liquid mixture of brine and water, a liquid mixture of water and an additive with a high anti-corrosion effect, or the like can be used. Therefore, use of such a highly safe heat medium contributes to improvement of safety even if the heat medium leaks to the indoor space 7 via the indoor unit 2 in the air-conditioning apparatus 100.

While the air-conditioning apparatus 100 has been described above as being capable of the cooling and heating mixed operation, this should not be construed restrictively. For example, the same effect can be obtained also in the case of a configuration in which there are provided a single intermediate heat exchanger 15 and a single expansion device 16, a plurality of use-side heat exchangers 26 and a plurality of heat medium flow control devices 25 are connected in parallel to the intermediate heat exchanger 15 and the expansion device 16, and only one of a cooling operation and a heating operation can be executed.

Further, while the case where the heat medium flow control device 25 is built in the heat medium relay unit 3 has been described by way of example, this should not be construed restrictively. The heat medium flow control device 25 may be built in the indoor unit 2.

Generally, in many cases, an air-sending device is attached to the heat source-side heat exchanger 12 and the use-side heat exchanger 26, and condensation or evaporation is promoted by blowing air. However, this should not be construed restrictively. For example, as the use-side heat exchanger 26, a heat exchanger that uses radiation like a panel heater can be used, and as the heat source-side heat exchanger 12, a water-cooled type heat exchanger that moves heat by water or antifreeze can be used. That is, any type of heat source-side heat exchanger 12 and use-side heat exchanger 26 can be used as long as their structure allows heat to be rejected or removed.

Next, a method of calculating the power consumption of each indoor unit according to Embodiment of the present invention will be described.

Figure 7:
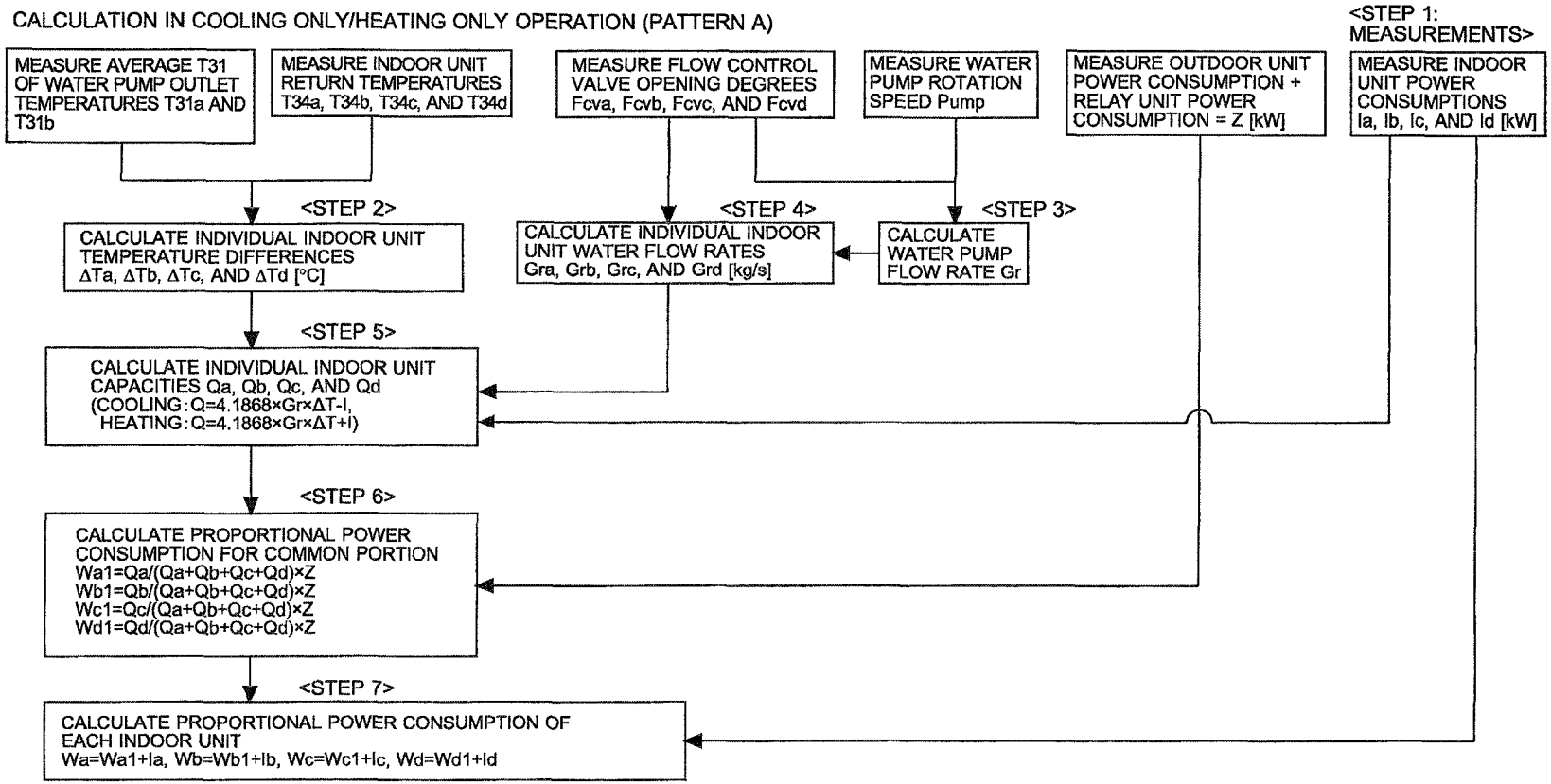
FIG. 7 is a flowchart illustrating a flow (pattern A) of calculating proportional power consumption for each indoor unit in the cooling only/heating only operation which is adopted for the air-conditioning apparatus according to Embodiment 1.

FIG. 7 is a flowchart illustrating a method (pattern A) of calculating proportional power consumption for each of the indoor units 2 in the cooling only/heating only operation adopted for the air-conditioning apparatus 100 according to Embodiment 1.

(Step 1)

First, measurements necessary for calculation are performed. The following values are measured: the temperatures at the outlet or inlet of the respective pumps 21 (values T31a and T31b respectively measured by the first temperature sensor 31*a* and 31*b* in this case); the return temperature T34 of the heat medium from the indoor unit 2 side (values T34a to T34d respectively measured by the second temperature sensors 34*a* to 34*d* in this case); the valve opening degrees Fcv (Fcva, Fcvb, Fcvc, and Fcvd) of the respective heat medium flow control devices 25 (25*a* to 25*d*); the rotation speed Pump of the pump 21 (the rotation speed is assumed to be the same between the pumps 21*a* and 21*b* in this case); the power consumption Z [kW] of the outdoor unit 1 and the heat medium relay unit (relay unit) 3; and the power consumptions I (Ia, Ib, Ic, and Id [kW]) of the respective indoor units 2. At this time, on the basis of the values T31a and T31b respectively measured by the first temperature sensors 31*a* and 31*b*, the average T31 of these values is calculated in advance.

(Step 2)

Next, the difference ΔT (=T34−T31 [cooling] or =T31−T34 [heating]) between the temperatures of the heat medium on the upstream and downstream sides of the indoor unit 2 is calculated for each of the indoor units 2 (2*a* to 2*d*).

(Step 3)

The total flow rate Gr of the pump 21 is calculated from the rotation speed Pump of the pump 21, and the sum total of the valve opening degrees Fcv (Fcva to Fcvd) of the heat medium flow control devices 25 (25*a* to 25*d*).

(Step 4)

Further, from the total flow rate Gr of the pump, and the valve opening degrees Fcv (Fcva to Fcvd), the flow rates of water Gra, Grb, Grc, and Grd [kg/s] through the respective indoor units 2 are calculated.

(Step 5)

Then, the capacities Q (Qa to Qd) of the respective indoor units 2 are calculated. In the case of cooling, each of the capacities Q is computed by subtracting the indoor unit power consumption I from the product of the temperature difference ΔT and the flow rate of water mentioned above, and in the case of heating, each of the capacities Q is computed by adding the indoor unit power consumption I to the product of the temperature difference ΔT and the flow rate of water mentioned above.

(Step 6)

Next, the sum total Z of the power consumptions of the outdoor unit 1 and heat medium relay unit 3 is proportionally divided in accordance with the capacities Q (Qa to Qd) of the respective indoor units, thereby calculating the proportional power consumption for the common portion of the air-conditioning apparatus.

(Step 7)

The power consumption of each indoor unit 2 itself is added to the proportional power consumption for the common portion computed in step S6 to thereby compute the proportional power consumption for each of the indoor units 2 (2*a* to 2*d*).

In this way, the electricity usage for the common portion can be proportionally divided also in the case of an air-conditioning apparatus adopting a secondary loop system that uses a refrigerant, water, and the like as heat media. Therefore, the electric usage bill can be calculated for each indoor unit, thereby enabling accurate distribution of the electric bill.

Figure 8:
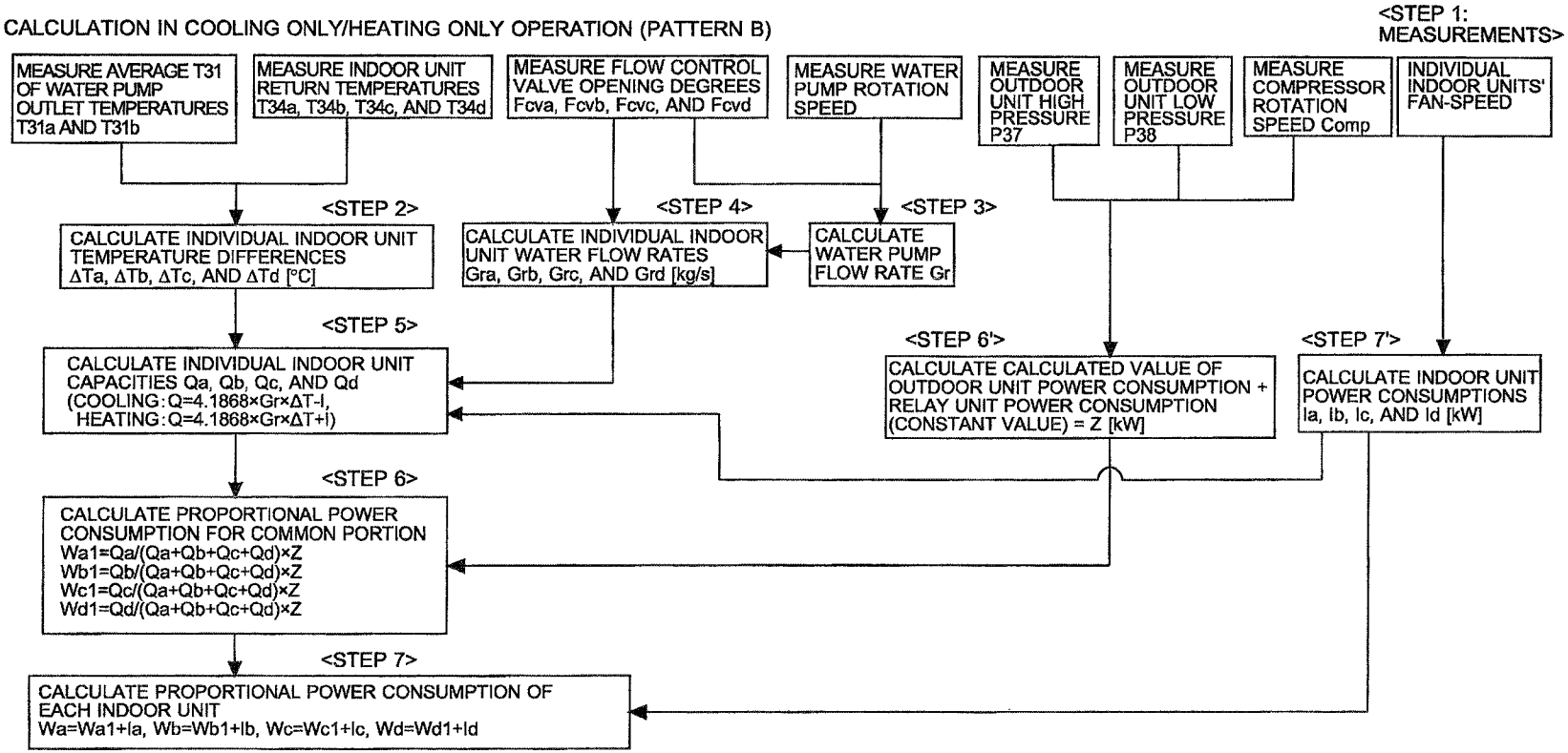
FIG. 8 is a flowchart illustrating a flow (pattern B) of calculating proportional power consumption for each indoor unit in the cooling only/heating only operation which is adopted for the air-conditioning apparatus according to Embodiment 1.

FIG. 8 is a flowchart illustrating a method (pattern B) of calculating proportional power consumption for each of the indoor units 2 in the cooling only/heating only operation adopted for the air-conditioning apparatus 100 according to Embodiment 1. In FIG. 8, in the calculation method illustrated in FIG. 7, the power consumptions I of the outdoor unit 1, heat medium relay unit (relay unit) 3, and indoor unit 2 are calculated from their respective operating states.

(Step 1)

First, measurements necessary for calculation are performed. As the values to be measured at this time, among the measured values illustrated in FIG. 7, the power consumption Z [kW] of the outdoor unit 1 and the heat medium relay unit (relay unit) 3, and the power consumption I of each indoor unit are replaced by the following measured values: a high-pressure detection value 37 and a low-pressure detection value 38 (which are obtained from the values measured by the second pressure sensor 37 and the third pressure sensor 38 located on the upstream and downstream sides of the compressor 10, respectively) of the outdoor unit 1; the rotation speed of the compressor 10; and the fan speed of the indoor unit 2.

The processes in (step 2), (step 3), and (step 4) are the same as those in FIG. 7.

(Step 5)

The capacities Q (Qa to Qd) of the respective indoor units 2 are calculated. In the case of cooling, each of the capacities Q is computed by subtracting the indoor unit power consumption I from the product of the temperature difference ΔT and the flow rate of water mentioned above, and in the case of heating, each of the capacities Q is computed by adding the indoor unit power consumption I to the product of the temperature difference ΔT and the flow rate of water mentioned above. The power consumption I of each indoor unit is calculated in step 7'.

(Step 6')

Outdoor unit power consumption is calculated from the high-pressure detection value 37 and the low-pressure detection value 38 of the outdoor unit 1 and the rotation speed of the compressor 10. Then, the power consumption (constant value) of the heat medium relay unit (relay unit) 3 is added to the calculated outdoor unit power consumption to thereby calculate Z [kW].

(Step 6)

The sum total Z of the outdoor unit power consumption and the relay unit power consumption is proportionally divided by the capacity Q of each of the indoor units 2 to calculate proportional power consumption for the common portion.

(Step 7')

Indoor unit power consumption stored in advance is calculated from the fan speed of each of the indoor units 2.

(Step 7)

The power consumption of each indoor unit 2 itself is added to the proportional power consumption for the common portion computed in step S6 to thereby compute the proportional power consumption for each of the indoor units 2 (2*a* to 2*d*).

As described above, by utilizing information on the actual operations of the outdoor and indoor units, the same effect as that in the case of FIG. 7 can be obtained.

Figure 9:
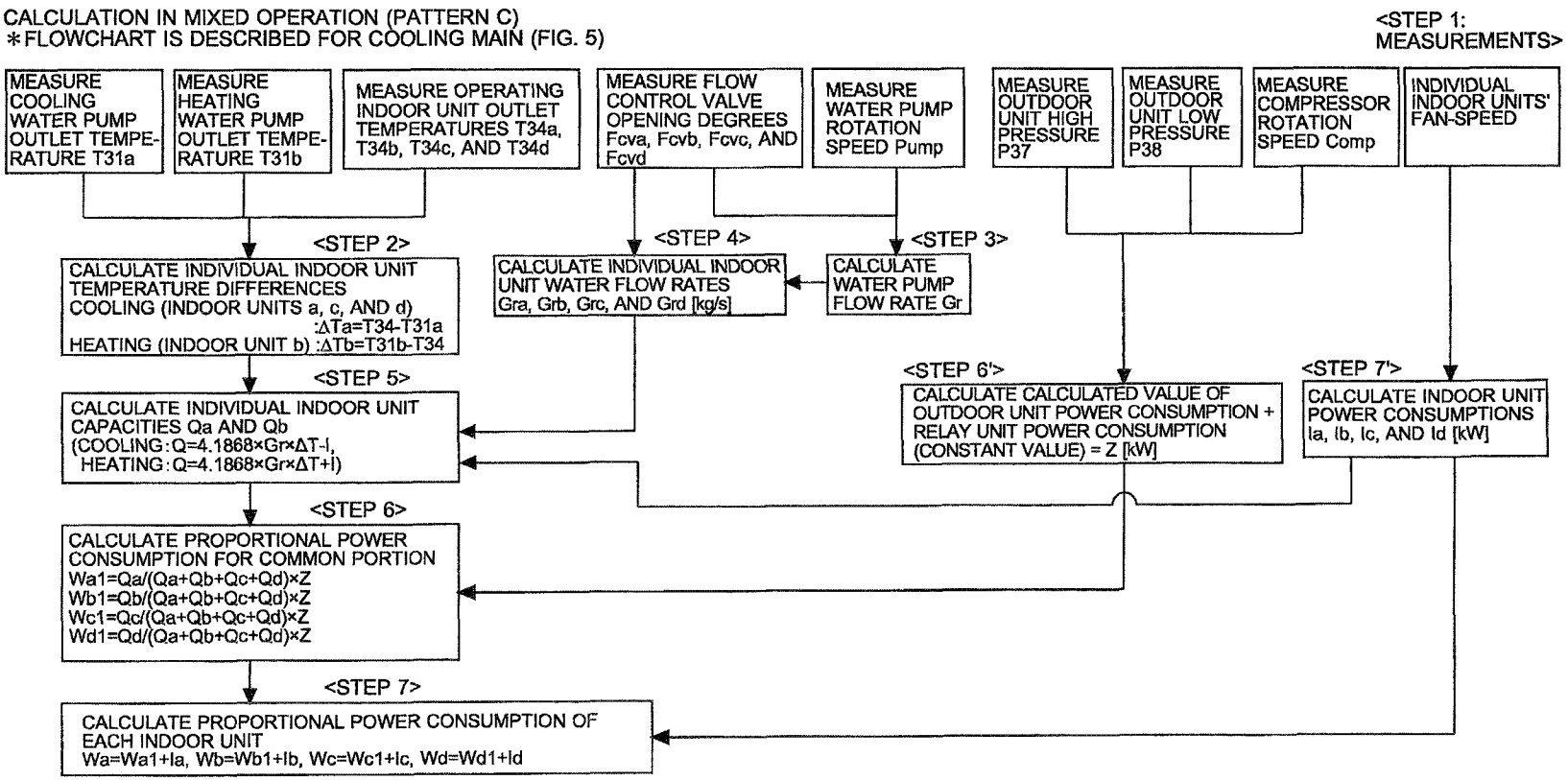
FIG. 9 is a flowchart illustrating a flow (pattern C) of calculating proportional power consumption for each indoor unit in a cooling and heating mixed operation which is adopted for the air-conditioning apparatus according to Embodiment 1.

FIG. 9 is a flowchart illustrating a method (pattern C) of calculating proportional power consumption for each of the indoor units 2 in the cooling and heating mixed operation adopted for the air-conditioning apparatus 100 according to Embodiment 1.

(Step 1)

First, measurements necessary for calculation are performed. While the objects to be measured are the same as those in the case of FIG. 8, as the outlet temperatures of the pumps 21*a* and 21*b*, not the average value of these temperatures is used as in FIG. 8, but their respective measured values are used.

(Step 2)

Next, the temperature difference ΔT (=T34−T31 [cooling] or =T31−T34 [heating]) for each indoor unit is calculated for each of the indoor units 2 (2*a* to 2*d*).

(Step 3)

The total flow rate Gr of the pump 21 is calculated from the rotation speed Pump of the pump 21, and the sum total of the valve opening degrees Fcv (Fcva to Fcvd) of the heat medium flow control devices 25 (25*a* to 25*d*).

(Step 4)

Further, from the total flow rate Gr of the pump, and the valve opening degrees Fcv, the flow rates of water Gra, Grb, Grc, and Grd [kg/s] through the respective indoor units 2 are calculated.

(Step 5)

The capacities Q (Qa to Qd) of the respective indoor units 2 are calculated. Each of the capacities Q is calculated by, in the case of cooling, subtracting the indoor unit power consumption I of each of the indoor units 2 from the product of the temperature difference ΔT and the flow rate of water through the corresponding indoor unit 2, and in the case of heating, adding the indoor unit power consumption I of the indoor unit 2 to the above-mentioned product. The power consumption I of each of the indoor units is calculated in step 7'.

(Step 6')

Outdoor unit power consumption is calculated from the high-pressure detection value 37 and the low-pressure detection value 38 of the outdoor unit 1 and the rotation speed of the compressor 10. Then, the power consumption (constant value) of the heat medium relay unit (relay unit) 3 is added to the calculated outdoor unit power consumption to thereby calculate Z.

The processes in (step 6), (step 7'), and (step 7) are the same as those in FIG. 8.

In this way, the proportional power consumption for the common portion can be determined also in the case of an air-conditioning apparatus adopting a secondary loop system that uses a refrigerant, water, and the like as heat media. Therefore, the electric usage bill can be calculated for each indoor unit, thereby enabling accurate distribution of the electric bill.

[With Regard to Correction of Fcv]

Incidentally, as for the opening degree Fcv of the heat medium flow control device 25, a difference occurs in the opening degree in a case where the pipe length between the indoor unit 2 and the heat medium relay unit 3 is large. Consequently, with the methods illustrated in FIGS. 7 to 9, a difference may occur in the calculation of power consumption in some cases. Accordingly, a method for correcting Fcv used in the methods illustrated in FIGS. 7 to 9 will be described with reference to FIG. 10 and FIG. 11.

After initial construction is finished (step 101), a trial operation is executed (step 102). Thereafter, one indoor unit 2*a* of the indoor units 2 is operated at constant fan speed (step 103).

The operation is regarded as stable if the above-mentioned temperature difference ΔTa (see step 2 in FIGS. 7 to 9; ΔTb, ΔTc, and ΔTd in association with the corresponding indoor units) falls within the range of ±0.5 degrees C. of the target value consecutively for three minutes (step 104).

Once the operation of the indoor unit 2*a* becomes stable, a reference value FcvX computed from a chart as illustrated in FIG. 11 is calculated on the basis of a temperature T39 detected by the suction air temperature sensor 39 of the indoor unit 2*a*, the temperature T31 of the heat medium at the pump inlet, and the capacity of the indoor unit (step 105).

Further, from the difference between the current Fcv and the reference value FcvX, the correction value for Fcv used in electricity calculation in FIGS. 7 to 9 during normal operation is calculated (step 106).

Once step 6 is finished, it is determined whether calculation of the correction value has been finished for all of the indoor units 2 (2*b* to 2*d* in this case) that are installed (step 107). If there is any indoor unit 2 for which the correction value has not yet been calculated, the correction value is calculated in the same manner (step 108). Once calculation of the correction value is finished for all of the indoor units 2, the processing ends (step 109).

By using Fcv corrected by the correction value computed as mentioned above for executing the calculations illustrated in FIGS. 7 to 9, the proportional power consumption for each indoor unit can be computed more accurately.

Figure 10:
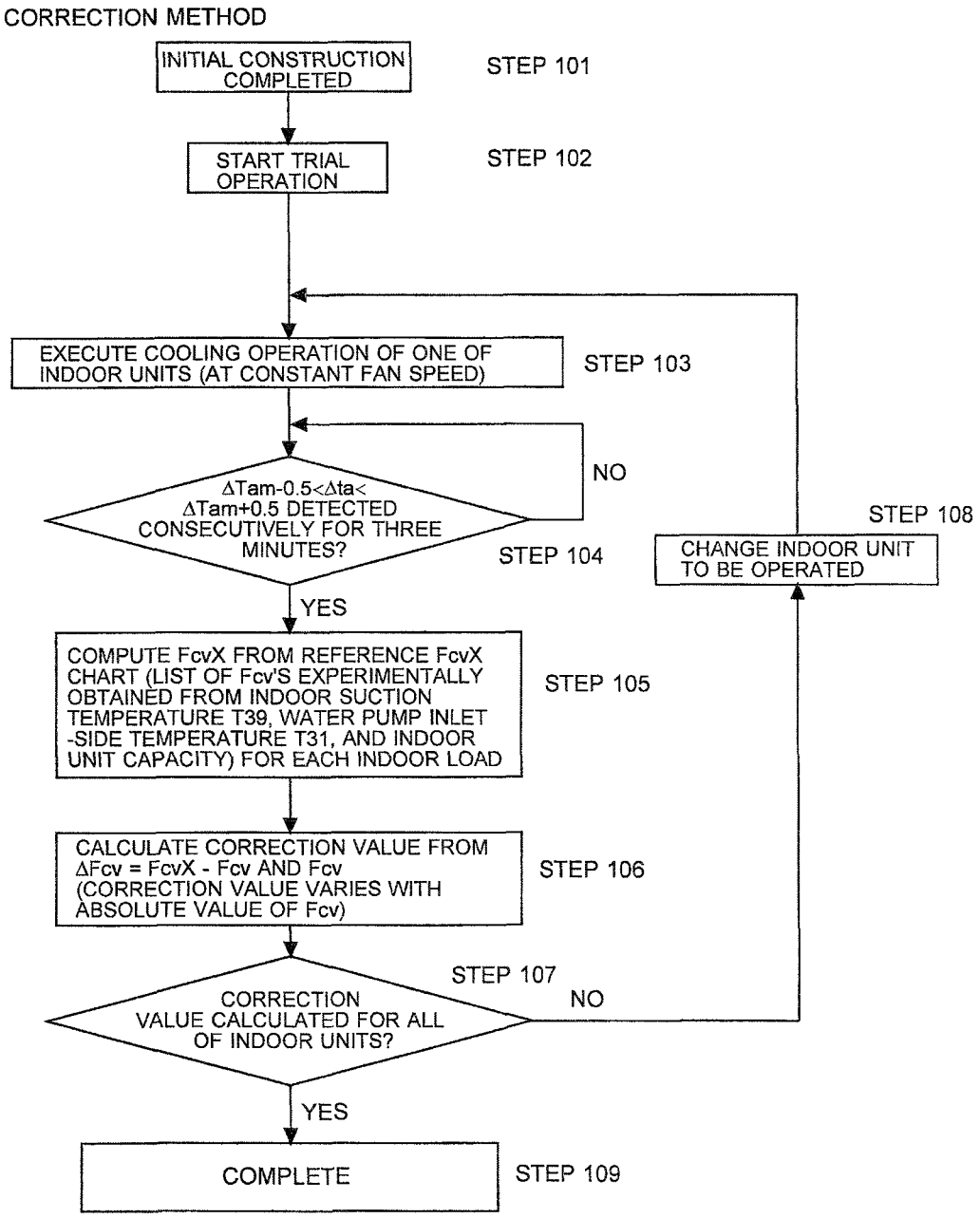
FIG. 10 illustrates a method of correcting the opening degrees Fcv of flow control valves which is employed in Embodiment 1.

While FIG. 10 is directed to a case in which Fcv correction is performed on the basis of the capacity in the operating state of the indoor unit 2, alternatively, pressure sensors may be attached at opposite ends of the pipe connecting the indoor unit 2 and the heat medium relay unit 3, and the correction value may be determined from the difference in value between these sensors.

The invention claimed is:

1. An air-conditioning apparatus comprising:

a refrigerant circuit configured to circulate a heat source-side refrigerant, the refrigerant circuit being a refrigerant-side flow path formed by connecting, with refrigerant pipes, a compressor, a refrigerant flow switching device, a heat source-side heat exchanger, a plurality of expansion devices, and a plurality of intermediate heat exchangers that exchange heat between the heat source-side refrigerant and a heat medium different from the refrigerant;

a heat medium circuit configured to circulate the heat medium, the heat medium circuit being a heat medium-side flow path formed by connecting, with heat medium pipes, a pump, a plurality of heat medium flow switching devices, a plurality of use-side heat exchangers that act as indoor units, a plurality of heat medium flow control devices, and the intermediate heat exchangers;

a heat medium relay unit that accommodates the plurality of intermediate heat exchangers, the pump and the plurality of heat medium flow switching devices;

temperature sensors configured to detect a temperature of the heat medium sent from each of the intermediate heat exchangers to each of the use-side heat exchangers, and a temperature of the heat medium that has exited each of the use-side heat exchangers; and a controller configured to control an opening degree of each of the heat medium flow control devices, determine a correction value for each of the heat medium flow control devices to correct a variation in the opening degree of each of the heat medium flow control devices caused by a difference in pipe length between each of the intermediate heat exchangers and each of the indoor units, compute a usage capacity of each of the indoor units from a rotation speed of the pump, a corrected opening degree of each of the heat medium flow control devices, the temperatures detected by the temperature sensors, and a power consumption of each of the indoor units, the corrected opening degree being obtained by correcting the opening degree of each of the heat medium flow control devices by the correction value, compute a power consumption for a common portion that is common to each of the indoor units, and compute a divided power consumption for the common portion for each of the indoor units by dividing the power consumption for the common portion among each of the indoor units proportionally to the computed usage capacity of each of the indoor units.

2. The air-conditioning apparatus of claim 1, wherein the power consumption for the common portion includes a power consumption of an outdoor unit including the compressor, and a power consumption of a portion between the outdoor unit and each of the indoor units.

3. The air-conditioning apparatus of claim 1, wherein the controller is configured to compute the power consumption of each of the indoor units from a rotation speed of a fan provided in association with each of the use-side heat exchangers of the indoor units.

4. The air-conditioning apparatus of claim 3, wherein the controller is configured to compute the power consumption of the outdoor unit from a rotation speed of the compressor, and pressures on upstream and downstream sides of the compressor.

5. The air-conditioning apparatus of claim 1, wherein the controller is configured to compute a total power consumption for each of the indoor units by adding the power consumption of each of the indoor units to the divided power consumption for the common portion of each of the indoor units.

6. The air-conditioning apparatus of claim 1, wherein the correction value determined for each of the heat medium flow control devices is determined on a basis of a difference between a reference opening degree being predetermined based on a suction air temperature of each of the indoor units, a temperature of the heat medium at an inlet of the pump, and a capacity of each of the indoor units, and a measurement opening degree that is obtained by measurement of the opening degree of each of the heat medium flow control devices in a trial operation.

7. The air-conditioning apparatus of claim 1, wherein pressure sensors are attached at opposite ends of a pipe that connects each of the indoor units and the heat medium relay unit, and the correction value is determined from a difference between values detected by the pressure sensors.

8. The air-conditioning apparatus of claim 1, wherein the common portion includes at least the refrigerant circuit, the pump of the heat medium circuit, and the intermediate heat exchangers of the heat medium circuit.

9. The air-conditioning apparatus of claim 1, wherein the common portion includes at least the refrigerant circuit and the heat medium relay unit.

10. The air-conditioning apparatus of claim 1, wherein the heat medium relay unit connects the refrigerant circuit to the heat medium circuit.

* * * * *